US012733677B2

(12) United States Patent
Alston et al.

(10) Patent No.: US 12,733,677 B2
(45) Date of Patent: Sep. 15, 2026

(54) VAPORIZER CARTRIDGE FOR HEATING MORE THAN ONE VAPORIZABLE MATERIAL

(71) Applicant: JUUL Labs, Inc., San Francisco, CA (US)

(72) Inventors: William W. Alston, San Jose, CA (US); Adam Bowen, San Mateo, CA (US); Jacob R. Davis, San Francisco, CA (US); Ian Garcia-Doty, Oakland, CA (US); Eddie G. Gonzalez, San Francisco, CA (US); Bradley J. Ingebrethsen, Saugerties, NY (US); Joshua A. Kurzman, San Francisco, CA (US); James Monsees, San Francisco, CA (US); Andrew J. Pappas, San Francisco, CA (US); Bretton M. Swope, San Francisco, CA (US); Paul R. Vieira, Oakland, CA (US); Timothy J. Watson, San Francisco, CA (US); Joseph S. Wilinski, Jr., San Francisco, CA (US)

(73) Assignee: JUUL Labs, Inc., Washington, DC (US)

( * ) Notice: Subject to any disclaimer, the term of this patent is extended or adjusted under 35 U.S.C. 154(b) by 771 days.

(21) Appl. No.: 17/982,230

(22) Filed: Nov. 7, 2022

(65) Prior Publication Data

US 2023/0054752 A1 Feb. 23, 2023

Related U.S. Application Data

(63) Continuation of application No. PCT/US2021/031084, filed on May 6, 2021.
(Continued)

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01); *A24F 40/46* (2020.01)

(58) Field of Classification Search
CPC ..... A24F 40/30
See application file for complete search history.

(56) References Cited

U.S. PATENT DOCUMENTS 720,007 A 2/1903 Dexter
1,165,000 A 12/1915 Dula
(Continued)

FOREIGN PATENT DOCUMENTS

CA 2641869 A1 5/2010
CA 2940842 A1 9/2015
(Continued)

OTHER PUBLICATIONS

Becker, et al. (Jul. 1, 1985) "PTC Heating Elements-Background Analysis and Design Attributes", 8095 IEEE Transactions on Industry Applications, IA-21(4):896-898.

*Primary Examiner* — Michael H. Wilson
*Assistant Examiner* — Michael T Fulton
(74) *Attorney, Agent, or Firm* — Mintz, Levin, Cohn, Ferris, Glovsky and Popeo, P.C.

(57) ABSTRACT

Various embodiments of a vaporization device are described that include one or more features for generating a combined inhalable aerosol. In some embodiments, the vaporization device can include one or more heating elements that are configured to heat one or more vaporizable materials. Various embodiments of heating elements, as well as heating and
(Continued)

airflow systems for use in vaporization devices for generating the combined inhalable aerosol are also described.

19 Claims, 14 Drawing Sheets

Related U.S. Application Data

(60) Provisional application No. 63/021,470, filed on May 7, 2020.

(51) Int. Cl.

| | |
|---|---|
| ***A24F 40/20*** | (2020.01) |
| ***A24F 40/42*** | (2020.01) |
| ***A24F 40/46*** | (2020.01) |

(56) References Cited

U.S. PATENT DOCUMENTS

| | | | |
|---|---|---|---|
| 2,158,928 | A | 5/1939 | Sol |
| 3,292,634 | A | 12/1966 | Beucler |
| 4,303,083 | A | 12/1981 | Burruss et al. |
| 4,708,151 | A | 11/1987 | Shelar |
| 4,771,796 | A | 9/1988 | Myer |
| 5,101,838 | A | 4/1992 | Schwartz et al. |
| 5,144,962 | A | 9/1992 | Counts et al. |
| 5,152,456 | A | 10/1992 | Ross et al. |
| 5,159,942 | A | 11/1992 | Brinkley et al. |
| 5,261,424 | A | 11/1993 | Sprinkel et al. |
| 5,497,791 | A | 3/1996 | Bowen et al. |
| 5,529,078 | A | 6/1996 | Rehder et al. |
| 5,564,442 | A | 10/1996 | Macdonald et al. |
| 5,708,258 | A | 1/1998 | Counts et al. |
| 6,095,153 | A | 8/2000 | Kessler et al. |
| 6,513,524 | B1 | 2/2003 | Storz |
| 6,603,924 | B2 | 8/2003 | Brown et al. |
| 6,772,756 | B2 | 8/2004 | Shayan |
| 7,040,314 | B2 | 5/2006 | Nguyen et al. |
| 7,434,584 | B2 | 10/2008 | Steinberg |
| 7,832,410 | B2 | 11/2010 | Hon |
| 8,371,310 | B2 | 2/2013 | Brenneise |
| 8,714,150 | B2 | 5/2014 | Alelov |
| 8,752,545 | B2 | 6/2014 | Buchberger |
| 8,794,231 | B2 | 8/2014 | Thorens et al. |
| 8,833,364 | B2 | 9/2014 | Buchberger |
| 8,881,737 | B2 | 11/2014 | Collett et al. |
| 8,910,639 | B2 | 12/2014 | Chang et al. |
| 8,948,578 | B2 | 2/2015 | Buchberger |
| 9,078,473 | B2 | 7/2015 | Worm et al. |
| 9,271,528 | B2 | 3/2016 | Liu |
| 9,282,772 | B2 | 3/2016 | Tucker et al. |
| 9,364,800 | B2 | 6/2016 | Dubief |
| 9,462,832 | B2 | 10/2016 | Lord |
| 9,497,999 | B2 | 11/2016 | Lord |
| 9,609,893 | B2 | 4/2017 | Novak et al. |
| 9,675,109 | B2 | 6/2017 | Monsees et al. |
| 9,717,276 | B2 | 8/2017 | Brammer et al. |
| 9,839,238 | B2 | 12/2017 | Worm et al. |
| 9,913,493 | B2 | 3/2018 | Worm et al. |
| 9,943,108 | B2 | 4/2018 | Lord |
| 9,974,335 | B2 | 5/2018 | Lord |
| 10,111,466 | B2 | 10/2018 | Lord |
| 10,194,689 | B2 | 2/2019 | Schennum et al. |
| 10,206,429 | B2 | 2/2019 | Davis et al. |
| 10,278,421 | B2 | 5/2019 | Lord |
| 10,278,424 | B2 | 5/2019 | Garthaffner et al. |
| 10,368,580 | B2 | 8/2019 | Rostami et al. |
| 10,375,990 | B2 | 8/2019 | Lord |
| 10,609,958 | B2 | 4/2020 | Robinson et al. |
| 10,653,180 | B2 | 5/2020 | Monsees et al. |
| 11,589,617 | B2 | 2/2023 | Yilmaz |
| 2002/0146242 | A1 | 10/2002 | Vieira |
| 2005/0016550 | A1 | 1/2005 | Katase |
| 2005/0067503 | A1 | 3/2005 | Katase |
| 2005/0150488 | A1 | 7/2005 | Dave |
| 2007/0006889 | A1 | 1/2007 | Kobal et al. |
| 2008/0023003 | A1 | 1/2008 | Rosenthal |
| 2008/0092912 | A1 | 4/2008 | Robinson et al. |
| 2008/0257367 | A1 | 10/2008 | Paterno et al. |
| 2009/0095287 | A1 | 4/2009 | Emarlou |
| 2009/0133691 | A1 | 5/2009 | Yamada et al. |
| 2009/0151717 | A1 | 6/2009 | Bowen et al. |
| 2009/0230117 | A1 | 9/2009 | Fernando et al. |
| 2009/0255534 | A1 | 10/2009 | Paterno |
| 2009/0283103 | A1 | 11/2009 | Nielsen et al. |
| 2009/0293892 | A1 | 12/2009 | Williams et al. |
| 2009/0302019 | A1 | 12/2009 | Selenski et al. |
| 2009/0314299 | A1 | 12/2009 | Kilpatrick |
| 2010/0006092 | A1 | 1/2010 | Hale et al. |
| 2010/0200006 | A1 | 8/2010 | Robinson et al. |
| 2010/0313901 | A1 | 12/2010 | Fernando et al. |
| 2011/0030706 | A1 | 2/2011 | Gibson et al. |
| 2011/0036346 | A1 | 2/2011 | Cohen et al. |
| 2011/0126831 | A1 | 6/2011 | Fernandez Pernia |
| 2011/0209717 | A1 | 9/2011 | Han |
| 2011/0265806 | A1 | 11/2011 | Alarcon et al. |
| 2012/0006343 | A1 | 1/2012 | Renaud et al. |
| 2012/0048266 | A1 | 3/2012 | Alelov |
| 2012/0199146 | A1 | 8/2012 | Marangos |
| 2012/0199572 | A1 | 8/2012 | Shen et al. |
| 2012/0255546 | A1 | 10/2012 | Goetz et al. |
| 2012/0260927 | A1 | 10/2012 | Liu |
| 2012/0325227 | A1 | 12/2012 | Robinson et al. |
| 2013/0014772 | A1 | 1/2013 | Liu |
| 2013/0160780 | A1 | 6/2013 | Matsumoto et al. |
| 2013/0220315 | A1 | 8/2013 | Conley et al. |
| 2013/0255702 | A1 | 10/2013 | Griffith et al. |
| 2013/0298905 | A1 | 11/2013 | Levin et al. |
| 2014/0000638 | A1 | 1/2014 | Sebastian et al. |
| 2014/0096782 | A1 | 4/2014 | Ampolini et al. |
| 2014/0123989 | A1 | 5/2014 | LaMothe |
| 2014/0190503 | A1 | 7/2014 | Li et al. |
| 2014/0209105 | A1 | 7/2014 | Sears et al. |
| 2014/0238424 | A1 | 8/2014 | Macko et al. |
| 2014/0261486 | A1 | 9/2014 | Potter et al. |
| 2014/0261487 | A1 | 9/2014 | Chapman et al. |
| 2014/0261491 | A1 | 9/2014 | Chiolini et al. |
| 2014/0345631 | A1 | 11/2014 | Bowen et al. |
| 2014/0345635 | A1 | 11/2014 | Rabinowitz et al. |
| 2014/0366898 | A1 | 12/2014 | Monsees et al. |
| 2014/0366902 | A1 | 12/2014 | Chiolini et al. |
| 2015/0047662 | A1 | 2/2015 | Hopps |
| 2015/0101606 | A1 | 4/2015 | White |
| 2015/0128966 | A1 | 5/2015 | Lord |
| 2015/0136153 | A1 | 5/2015 | Lord |
| 2015/0157055 | A1 | 6/2015 | Lord |
| 2015/0196059 | A1 | 7/2015 | Liu |
| 2015/0216236 | A1 | 8/2015 | Bless et al. |
| 2015/0237917 | A1 | 8/2015 | Lord |
| 2015/0245659 | A1 | 9/2015 | Depiano et al. |
| 2015/0245669 | A1 | 9/2015 | Cadieux et al. |
| 2015/0258289 | A1 | 9/2015 | Henry et al. |
| 2015/0305409 | A1 | 10/2015 | Verleur et al. |
| 2015/0313284 | A1 | 11/2015 | Liu |
| 2015/0335070 | A1 | 11/2015 | Sears et al. |
| 2015/0351456 | A1 | 12/2015 | Johnson et al. |
| 2015/0374035 | A1 | 12/2015 | Sanchez et al. |
| 2016/0007653 | A1 | 1/2016 | Tu |
| 2016/0007654 | A1 | 1/2016 | Zhu |
| 2016/0021934 | A1 | 1/2016 | Cadieux et al. |
| 2016/0044967 | A1 | 2/2016 | Bowen et al. |
| 2016/0073693 | A1 | 3/2016 | Reevell |
| 2016/0081395 | A1 | 3/2016 | Thorens et al. |
| 2016/0106155 | A1 | 4/2016 | Reevell |
| 2016/0120218 | A1 | 5/2016 | Schennum et al. |
| 2016/0206000 | A1 | 7/2016 | Lord et al. |
| 2016/0219934 | A1 | 8/2016 | Li et al. |
| 2016/0242466 | A1 | 8/2016 | Lord et al. |
| 2016/0249682 | A1 | 9/2016 | Eadley et al. |
| 2016/0262453 | A1 | 9/2016 | Ampolini et al. |
| 2016/0262454 | A1 | 9/2016 | Sears et al. |
| 2016/0262459 | A1 | 9/2016 | Monsees et al. |
| 2016/0309784 | A1 | 10/2016 | Silvestrini et al. |

(56) References Cited

U.S. PATENT DOCUMENTS

| | | | |
|---|---|---|---|
| 2016/0309786 | A1 | 10/2016 | Holtz et al. |
| 2016/0331026 | A1 | 11/2016 | Cameron |
| 2016/0331030 | A1 | 11/2016 | Ampolini et al. |
| 2016/0331034 | A1 | 11/2016 | Cameron |
| 2017/0027226 | A1 | 2/2017 | Mironov et al. |
| 2017/0035113 | A1 | 2/2017 | Thorens |
| 2017/0065000 | A1* | 3/2017 | Sears ..... A24F 40/40 |
| 2017/0127722 | A1 | 5/2017 | Davis et al. |
| 2017/0127725 | A1 | 5/2017 | Buchberger et al. |
| 2017/0135399 | A1 | 5/2017 | Gavrielov et al. |
| 2017/0135401 | A1 | 5/2017 | Dickens |
| 2017/0143038 | A1 | 5/2017 | Dickens |
| 2017/0143041 | A1 | 5/2017 | Batista et al. |
| 2017/0156403 | A1 | 6/2017 | Gill et al. |
| 2017/0164657 | A1 | 6/2017 | Batista |
| 2017/0181471 | A1 | 6/2017 | Phillips et al. |
| 2017/0188626 | A1 | 7/2017 | Davis et al. |
| 2017/0188629 | A1 | 7/2017 | Dickens et al. |
| 2017/0196268 | A1 | 7/2017 | Reevell |
| 2017/0208857 | A1 | 7/2017 | Branton et al. |
| 2017/0224014 | A1 | 8/2017 | Fraser |
| 2017/0231284 | A1 | 8/2017 | Newns |
| 2017/0245543 | A1 | 8/2017 | Karles et al. |
| 2017/0251721 | A1 | 9/2017 | Rostami et al. |
| 2017/0258134 | A1 | 9/2017 | Kane |
| 2017/0258137 | A1 | 9/2017 | Smith et al. |
| 2017/0258138 | A1 | 9/2017 | Rostami et al. |
| 2017/0265524 | A1 | 9/2017 | Cadieux et al. |
| 2017/0280767 | A1 | 10/2017 | Li et al. |
| 2017/0280768 | A1 | 10/2017 | Lipowicz |
| 2017/0283154 | A1 | 10/2017 | Karles et al. |
| 2017/0290370 | A1 | 10/2017 | Garthaffner et al. |
| 2017/0303586 | A1 | 10/2017 | Sur |
| 2017/0325502 | A1 | 11/2017 | Nelson et al. |
| 2017/0325506 | A1 | 11/2017 | Batista |
| 2017/0333650 | A1 | 11/2017 | Buchberger et al. |
| 2017/0347706 | A1 | 12/2017 | Aoun et al. |
| 2018/0000158 | A1 | 1/2018 | Ewing et al. |
| 2018/0016040 | A1 | 1/2018 | Ewing et al. |
| 2018/0027875 | A1 | 2/2018 | Rostami et al. |
| 2018/0027879 | A1 | 2/2018 | Gavrielov et al. |
| 2018/0035717 | A1 | 2/2018 | Batista |
| 2018/0070633 | A1 | 3/2018 | Phillips et al. |
| 2018/0070641 | A1 | 3/2018 | Batista et al. |
| 2018/0085539 | A1 | 3/2018 | Trzecieski |
| 2018/0132525 | A1 | 5/2018 | Patil et al. |
| 2018/0160733 | A1 | 6/2018 | Leadley et al. |
| 2018/0168227 | A1 | 6/2018 | Fraser et al. |
| 2018/0169357 | A1 | 6/2018 | Reevell |
| 2018/0184712 | A1 | 7/2018 | Fraser et al. |
| 2018/0192700 | A1 | 7/2018 | Fraser et al. |
| 2018/0271151 | A1 | 9/2018 | Litten |
| 2018/0271154 | A1 | 9/2018 | Leadley et al. |
| 2018/0271155 | A1 | 9/2018 | Baker et al. |
| 2018/0279679 | A1 | 10/2018 | Mcadam et al. |
| 2018/0343920 | A1 | 12/2018 | Sutton et al. |
| 2018/0360123 | A1 | 12/2018 | Silvestrini |
| 2018/0368472 | A1 | 12/2018 | Mishra et al. |
| 2019/0014825 | A1 | 1/2019 | Saygili |
| 2019/0021399 | A1 | 1/2019 | Silvestrini |
| 2019/0029320 | A1 | 1/2019 | Saygili |
| 2019/0045837 | A1 | 2/2019 | Spencer |
| 2019/0046745 | A1 | 2/2019 | Nettenstrom et al. |
| 2019/0083720 | A1 | 3/2019 | Leadley et al. |
| 2019/0098930 | A1 | 4/2019 | Fallon et al. |
| 2019/0098931 | A1 | 4/2019 | Leadley et al. |
| 2019/0099561 | A1 | 4/2019 | Nettenstrom et al. |
| 2019/0099562 | A1 | 4/2019 | Nettenstrom et al. |
| 2019/0099567 | A1 | 4/2019 | Nettenstrom et al. |
| 2019/0150520 | A1 | 5/2019 | Fraser et al. |
| 2019/0208821 | A1 | 7/2019 | Fraser et al. |
| 2019/0208822 | A1 | 7/2019 | Mullin |
| 2019/0208824 | A1 | 7/2019 | Wright |
| 2019/0223508 | A1 | 7/2019 | Otiaba et al. |
| 2019/0246693 | A1 | 8/2019 | Nettenstrom et al. |
| 2019/0320718 | A1 | 10/2019 | Yimaz et al. |
| 2020/0000151 | A1 | 1/2020 | Fraser et al. |
| 2020/0029618 | A1 | 1/2020 | Fraser et al. |
| 2020/0037667 | A1 | 2/2020 | Woodcock |
| 2020/0037669 | A1 | 2/2020 | Bowen et al. |
| 2020/0038601 | A1 | 2/2020 | Hepworth et al. |
| 2020/0046025 | A1 | 2/2020 | Otiaba et al. |
| 2020/0060348 | A1* | 2/2020 | Mironov ..... A24F 40/50 |
| 2020/0107572 | A1 | 4/2020 | Marques Borges et al. |
| 2020/0113234 | A1 | 4/2020 | Patoret |
| 2020/0146352 | A1 | 5/2020 | Alston et al. |
| 2020/0154771 | A1 | 5/2020 | Otiaba et al. |
| 2020/0163376 | A1 | 5/2020 | Saygili et al. |
| 2020/0221777 | A1 | 7/2020 | Saygili et al. |
| 2020/0260783 | A1 | 8/2020 | Waller et al. |
| 2020/0275696 | A1 | 9/2020 | Atkins et al. |
| 2021/0084986 | A1 | 3/2021 | Hepworth et al. |
| 2021/0145051 | A1 | 5/2021 | Florack et al. |
| 2021/0145072 | A1 | 5/2021 | Mullin et al. |
| 2021/0204609 | A1 | 7/2021 | Bilat et al. |
| 2021/0337872 | A1 | 11/2021 | Alston et al. |
| 2022/0279846 | A1 | 9/2022 | Alston et al. |
| 2023/0042402 | A1 | 2/2023 | Alston |

FOREIGN PATENT DOCUMENTS

| | | | |
|---|---|---|---|
| CN | 1541577 | A | 11/2004 |
| CN | 201630238 | U | 11/2010 |
| CN | 102612361 | A | 7/2012 |
| CN | 202738816 | U | 9/2012 |
| CN | 202873796 | U | 4/2013 |
| CN | 103156273 | A | 6/2013 |
| CN | 103929985 | A | 7/2014 |
| CN | 203748667 | U | 8/2014 |
| CN | 104544567 | A | 4/2015 |
| CN | 104684422 | A | 6/2015 |
| CN | 204409589 | U | 6/2015 |
| CN | 104770878 | A | 7/2015 |
| CN | 102762118 | B | 8/2015 |
| CN | 104968225 | A | 10/2015 |
| CN | 204837995 | U | 12/2015 |
| CN | 107594624 | A | 1/2018 |
| CN | 207476951 | U | 6/2018 |
| CN | 207754539 | U | 8/2018 |
| CN | 105473012 | B | 6/2020 |
| EP | 3066941 | A1 | 9/2016 |
| EP | 3085257 | A1 | 10/2016 |
| EP | 2753200 | B1 | 12/2017 |
| EP | 2961288 | B1 | 10/2018 |
| EP | 2961285 | B1 | 1/2019 |
| EP | 3344080 | B1 | 6/2020 |
| EP | 3285843 | B1 | 9/2020 |
| EP | 3481473 | B1 | 9/2020 |
| EP | 3484315 | B1 | 12/2020 |
| EP | 3525608 | B1 | 12/2020 |
| EP | 3562337 | B1 | 2/2021 |
| EP | 3522740 | B1 | 3/2021 |
| EP | 3232838 | B1 | 4/2021 |
| EP | 3562535 | B1 | 4/2021 |
| EP | 3534733 | B1 | 6/2021 |
| EP | 3554295 | B1 | 7/2021 |
| EP | 3104723 | B1 | 8/2021 |
| EP | 3573486 | B1 | 9/2021 |
| EP | 3644770 | B1 | 9/2021 |
| GB | 1025630 | A | 4/1966 |
| GB | 1213318 | A | 11/1970 |
| GB | 2524779 | A | 10/2015 |
| JP | H03232481 | A | 10/1991 |
| JP | 2005058421 | A | 3/2005 |
| KR | 20130052119 | A | 5/2013 |
| KR | 10-2016-0112770 | A | 9/2016 |
| KR | 101691984 | B1 | 1/2017 |
| TW | 201436722 | A | 10/2014 |
| WO | WO-03082031 | A1 | 10/2003 |
| WO | WO-2004064548 | A1 | 8/2004 |
| WO | WO-2004089126 | A1 | 10/2004 |
| WO | WO-2010140841 | A2 | 12/2010 |
| WO | WO-2011042212 | A1 | 4/2011 |
| WO | WO-2012065310 | A1 | 5/2012 |

(56) References Cited

FOREIGN PATENT DOCUMENTS

| | | | | | |
|---|---|---|---|---|---|
| WO | WO-2015077311 | A1 | | 5/2015 | |
| WO | WO-2015150699 | A1 | | 10/2015 | |
| WO | WO-2016062777 | A1 | | 4/2016 | |
| WO | WO-2016079589 | A1 | | 5/2016 | |
| WO | WO-2016135342 | A2 | | 9/2016 | |
| WO | WO-2016145072 | A1 | | 9/2016 | |
| WO | WO-2016179376 | A1 | | 11/2016 | |
| WO | WO-2017042081 | A1 | | 3/2017 | |
| WO | WO-2017153486 | A1 | | 9/2017 | |
| WO | WO-2017153591 | A1 | | 9/2017 | |
| WO | WO-2017174754 | A1 | | 10/2017 | |
| WO | WO-2017185051 | A1 | * | 10/2017 | ..... A24F 40/30 |
| WO | WO-2017207443 | A1 | | 12/2017 | |
| WO | WO-2018029186 | A1 | | 2/2018 | |
| WO | WO-2019122880 | A1 | | 6/2019 | |
| WO | WO-2020081849 | A2 | | 4/2020 | |
| WO | WO-2020201026 | A1 | | 10/2020 | |

* cited by examiner

VAPORIZER CARTRIDGE FOR HEATING MORE THAN ONE VAPORIZABLE MATERIAL

CROSS-REFERENCE TO RELATED APPLICATION

This application is a bypass continuation and claims priority to PCT/US2021/031084, filed on May 6, 2021 and entitled "VAPORIZER CARTRIDGE FOR HEATING MORE THAN ONE VAPORIZABLE MATERIAL" which claims priority under 35 U.S.C. § 119 (a) to U.S. Provisional application Ser. No. 63/021,470, filed on May 7, 2020 and entitled "VAPORIZER CARTRIDGE FOR HEATING MORE THAN ONE VAPORIZABLE MATERIAL," the disclosures of which are incorporated by reference herein in their entirety.

TECHNICAL FIELD

The subject matter described herein relates to vaporizer devices, including vaporizer devices configured to heat a variety of vaporizable materials.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizers are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a compartment associated with a heating element) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporization device.

In some vaporizer device implementations, a liquid vaporizable material can be drawn out of a reservoir and into the vaporization chamber via a wicking element (e.g., a wick). Drawing of the vaporizable material into the vaporization chamber can be at least partially due to capillary action provided by the wick as the wick pulls the vaporizable material along the wick in the direction of the vaporization chamber. In other implementations, a solid vaporizable material (e.g., tobacco and/or or other plant material) may be positioned in the vaporization chamber for heating and/or vaporization.

SUMMARY

Aspects of the current subject matter relate to a system for generating a combined inhalable aerosol. In one aspect, a vaporizer device is described that can generate a combined inhalable aerosol. The vaporizer device can include a vaporizer cartridge having a first compartment configured to contain a first vaporizable material and a first heating element adjacent the first compartment for heating the first vaporizable material and forming a first inhalable aerosol. The vaporizer cartridge can include a second compartment configured to contain a second vaporizable material and a second heating element adjacent the second compartment for heating the second vaporizable material and forming a second inhalable aerosol. The vaporizer cartridge can further include an airflow pathway that extends adjacent the first heating element and the second heating element, and the airflow pathway can be configured to receive the first inhalable aerosol and the second inhalable aerosol and allow the first inhalable aerosol and the second inhalable aerosol to combine to form the combined inhalable aerosol for inhalation by a user from an end of the airflow pathway. The vaporizer device can include a vaporizer body having a power source configured to supply power to the first heating element and the second heating element when the vaporizer cartridge is coupled to the vaporizer body.

In some variations one or more of the following features can optionally be included in any feasible combination. At least one of the first compartment and the second compartment can be releasably coupled to a body of the vaporizer cartridge. The body can include a part of the airflow pathway that extends between the first compartment and the second compartment. The first vaporizable material can include a liquid vaporizable material. The second vaporizable material can include a solid vaporizable material. The second vaporizable material can be positioned adjacent the end of the airflow pathway. The airflow pathway can extend through the second vaporizable material contained in the second compartment. At least one of the first compartment and the second compartment can be refillable with a vaporizable material.

In some embodiments, the vaporizer body can further include a first pair of vaporizer body contacts in electrical communication with the power source and a second pair of vaporizer body contacts in electrical communication with the power source. The cartridge can further include a first pair of cartridge contacts in electrical and/or thermal communication with the first heating element and a second pair of cartridge contacts in electrical and/or thermal communication with the second heating element. The first pair of cartridge contacts can contact the first pair of vaporizer body contacts and the second pair of cartridge contacts can contact the second pair of vaporizer body contacts when the vaporizer cartridge is coupled to the vaporizer body for allowing the power source to activate the first heating element and the second heating element. The first compartment can include a reservoir for containing a liquid vaporizable material and an atomizer including the first heating element for heating the liquid vaporizable material to form a first inhalable aerosol. The first compartment can include a wick for drawing the first vaporizable material from the reservoir to the first heating element for heating and forming the first inhalable aerosol.

In some embodiments, the second heating element can include a thermally conductive sheet that extends from the body of the cartridge and into at least a part of the second compartment. The vaporizer cartridge can further include a tray having a positioning feature configured to position the second vaporizable material along the tray, and the tray can be configured for insertion into the second compartment for positioning the second vaporizable material adjacent to and/or in contact with the second heating element. The second vaporizable material can be formed into a shape having a tapered distal end. The second heating element can conform to one or more sides of the second vaporizable material. The vaporizer cartridge can further include a thermally conductive protective layer positioned between the second vaporizable material and the second heating element. The first compartment can include an inner passageway configured to receive the second compartment.

In another aspect, a vaporizer cartridge is described that can be used with a vaporizer body for generating a combined inhalable aerosol. The vaporizer cartridge can include a first compartment configured to contain a first vaporizable material, a first heating element adjacent the first compartment for heating the first vaporizable material and forming a first inhalable aerosol, and a second compartment configured to contain a second vaporizable material. The vaporizer cartridge can further include a second heating element adjacent the second compartment for heating the second vaporizable material and forming a second inhalable aerosol, and an airflow pathway that extends adjacent the first heating element and the second heating element, the airflow pathway being configured to receive the first inhalable aerosol and the second inhalable aerosol and allow the first inhalable aerosol and the second inhalable aerosol to combine to form the combined inhalable aerosol for inhalation by a user from an end of the airflow pathway.

In some variations one or more of the following features can optionally be included in any feasible combination. At least one of the first compartment and the second compartment can be releasably coupled to a body of the vaporizer cartridge. The body includes a part of the airflow pathway that extends between the first compartment and the second compartment. The first vaporizable material can be a liquid vaporizable material. The second vaporizable material can be a solid vaporizable material. The second vaporizable material can be positioned adjacent the end of the airflow pathway. The airflow pathway can extend through the second vaporizable material contained in the second compartment. At least one of the first compartment and the second compartment can be refillable with a vaporizable material.

In some embodiments, the vaporizer cartridge can further include a first pair of cartridge contacts in electrical and/or thermal communication with the first heating element, and a second pair of cartridge contacts in electrical and/or thermal communication with the second heating element. The first pair of cartridge contacts and the second pair of cartridge contacts can assist with providing power to the vaporizer cartridge to activate the first heating element and the second heating element. The first compartment can include a reservoir for containing a liquid vaporizable material and an atomizer including the first heating element for heating the liquid vaporizable material to form a first inhalable aerosol. The compartment can include a wick for drawing the first vaporizable material from the reservoir to the first heating element for heating and forming the first inhalable aerosol. The second heating element can include a thermally conductive sheet that extends from the body of the cartridge and into at least a part of the second compartment.

In some embodiments, the vaporizer cartridge can further include a tray having a positioning feature configured to position the second vaporizable material along the tray, and the tray can be configured for insertion into the second compartment for positioning the second vaporizable material adjacent to and/or in contact with the second heating element. The second vaporizable material can be formed into a shape having a tapered distal end. The second heating element can conform to one or more sides of the second vaporizable material. The vaporizer cartridge can further include a thermally conductive protective layer positioned between the second vaporizable material and the second heating element. The first compartment can include an inner passageway configured to receive the second compartment.

In yet another aspect, a vaporizer cartridge that can be used with a vaporizer body for generating a combined inhalable aerosol is described. The vaporizer cartridge can include a first compartment configured to contain a first vaporizable material, a second compartment configured to contain a second vaporizable material, and a heating element in thermal communication with the first vaporizable material for heating the first vaporizable material and forming a first inhalable aerosol. The heating element can be in thermal communication with the second vaporizable material for heating the second vaporizable material and forming a second inhalable aerosol. The vaporizer cartridge can further include an airflow pathway that extends adjacent the heating element and can be configured to allow the first inhalable aerosol and the second inhalable aerosol to combine to form the combined inhalable aerosol for inhalation by a user from an end of the airflow pathway.

In some variations one or more of the following features can optionally be included in any feasible combination. At least one of the first compartment and the second compartment can be releasably coupled to a body of the vaporizer cartridge. The body includes a part of the airflow pathway that extends between the first compartment and the second compartment. The first vaporizable material can be a liquid vaporizable material. The second vaporizable material can be a solid vaporizable material. The second vaporizable material can be positioned adjacent the end of the airflow pathway. The airflow pathway extends through the second vaporizable material contained in the second compartment. At least one of the first compartment and the second compartment can be refillable with a vaporizable material.

In some embodiments, the vaporizer cartridge can further include a first pair of cartridge contacts in electrical and/or thermal communication with the heating element. The first pair of cartridge contacts can assist with providing power to the vaporizer cartridge to activate the heating element. The first compartment can include a reservoir for containing a liquid vaporizable material and an atomizer including the heating element for heating the liquid vaporizable material to form a first inhalable aerosol. The first compartment can include a wick for drawing the first vaporizable material from the reservoir to the heating element for heating and forming the first inhalable aerosol. The vaporizable material can be formed into a shape having a tapered distal end. The heating element can conform to one or more sides of the vaporizable material. The vaporizer cartridge can further include a thermally conductive protective layer positioned between the vaporizable material and the heating element. The first compartment can include an inner passageway configured to receive the second compartment.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1A:
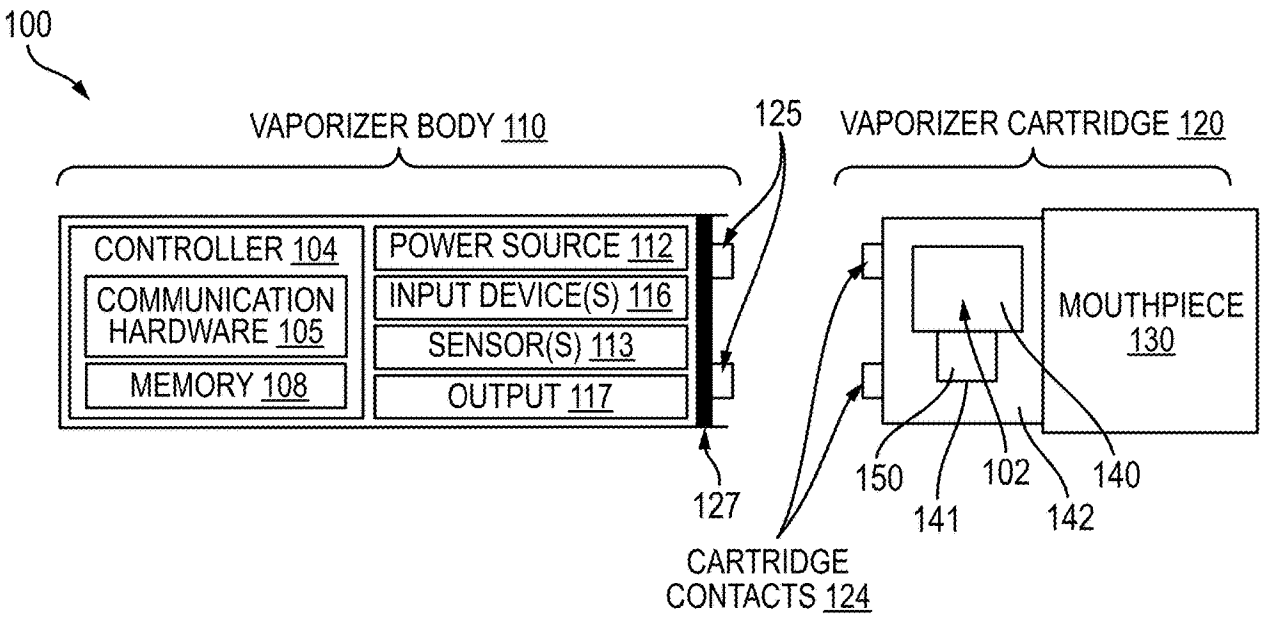
FIG. 1A illustrates a block diagram of a vaporizer device consistent with implementations of the current subject matter.

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material. The vaporizable material used with a vaporizer device can be provided within a cartridge (for example, a part of the vaporizer that contains the vaporizable material in a reservoir or other container) which can be refillable when empty, or disposable such that a new cartridge containing additional vaporizable material of a same or different type can be used.

A vaporizer device can be a cartridge-using vaporizer device, a cartridge-less vaporizer device, or a multi-use vaporizer device capable of use with or without a cartridge. For example, a vaporizer device can include a compartment for heating vaporizable material (e.g., an oven or other region in which material is heated by a heating element). For example, the compartment and/or a reservoir or the like can be configured to directly receive a vaporizable material, such as for containing the vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself), a paste, a gel, a wax, and/or a solid vaporizable material. A solid vaporizable material can include a plant material that emits some part of the plant material as the vaporizable material (for example, some part of the plant material remains as waste after the material is vaporized for inhalation by a user) or optionally can be a solid form of the vaporizable material itself, such that all of the solid material can eventually be vaporized for inhalation. A liquid vaporizable material can likewise be capable of being completely vaporized, or can include some portion of the liquid material that remains after all of the material suitable for inhalation has been vaporized.

Some vaporizer embodiments disclosed herein include a heating and airflow system having a first heating element that heats a first compartment and a second heating element that heats a second compartment. Such heating and airflow systems can be a part of the vaporizer cartridge and/or vaporizer body. For example, the first compartment may be configured to contain a liquid vaporizable material and the first heating element may be configured to heat and/or vaporize the liquid vaporizable material. Additionally, the second compartment may be configured to contain a solid vaporizable material and the second heating element may be configured to heat and/or vaporize the solid vaporizable material. The contents emitted from the first and second compartments as a result of being heated by the first and second heating elements, respectively, may be combined to form a combined vapor or aerosol for inhalation by a user, as will be described in greater detail below. This combined aerosol can be provided on-demand and include inhalable elements from both liquid and solid vaporizable material, which can provide an experience that is similar to smoking a traditional cigarette. Various vaporizer devices and heating and airflow systems, as well as associated features for achieving the above on-demand combined aerosol are described in greater detail below.

Various vaporizer cartridge embodiments are also described herein that can include an embodiment of the heating and airflow systems, such as any of the heating and airflow systems described herein. For example, some heating and airflow systems can be a part of the cartridge such that they can be replaced, along with the associated cartridge, for use with the vaporizer body.

Referring to the block diagram of FIG. 1A, a vaporizer device 100 can include a power source 112 (for example, a battery, which can be a rechargeable battery), and a controller 104 (for example, a processor, circuitry, etc. capable of executing logic) for controlling delivery of heat to a heating element 150, including a heating element that is part of an atomizer 141, to cause a vaporizable material 102 to be converted from a condensed form (such as a solid, a liquid, a solution, a suspension, a part of an at least partially unprocessed plant material, etc.) to the gas phase. The controller 104 can be part of one or more printed circuit boards (PCBs) consistent with certain implementations of the current subject matter.

After conversion of the vaporizable material 102 contained in a compartment 140 of the vaporizer cartridge 120 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. For example, the atomizer 141 can be positioned within a compartment 142 and adjacent to the reservoir 140 configured to contain a vaporizable material 102. The vaporizable material 102 can be a liquid. Examples of the vaporizable material 102 include neat liquids, suspensions, solutions, mixtures, and/or the like. The atomizer 141 can include a wicking element (i.e., a wick) configured to convey an amount of the vaporizable material 102 to a part of the atomizer 141 that includes the heating element 150.

For example, the wicking element can be configured to draw the vaporizable material 102 from the reservoir 140 configured to contain the vaporizable material 102, such that the vaporizable material 102 can be vaporized by heat delivered from a heating element 150. The wicking element can also optionally allow air to enter the reservoir 140 and replace the volume of vaporizable material 102 removed. In some implementations of the current subject matter, capillary action can pull vaporizable material 102 into the wick for vaporization by the heating element, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The cartridge 120 can include one or more heating elements 150, such as a first heating element that is a part of the atomizer 141 for vaporizing a liquid vaporizable material, as well as a second heating element that is configured to vaporize a second vaporizable material, such as a solid vaporizable material. As such, the vaporizer cartridge 120 can include more than one heating element 150 for vaporizing more than one vaporizable material 120 contained in the vaporizer cartridge 120.

In some embodiments, the heating element 150 can include one or more of a conductive heater, a radiative heater, and/or a convective heater. One type of heating element 150 is a resistive heating element, which can include a material (such as a metal or alloy, for example a nickel-chromium alloy, or a non-metallic resistor) configured to dissipate electrical power in the form of heat when electrical current is passed through one or more resistive segments of the heating element 150.

In some implementations of the current subject matter, the atomizer 141 can include a heating element 150 which includes a resistive coil or other heating element 150 that is wrapped around, positioned within, integrated into a bulk shape of, pressed into thermal contact with, or otherwise arranged to deliver heat to a wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer assembly configurations are also possible.

Certain vaporizer devices 100 may, additionally or alternatively, be configured to create an inhalable dose of the vaporizable material 102 in the gas phase and/or aerosol phase via heating of the vaporizable material 102. The vaporizable material 102 can be a solid-phase material (such as a wax or the like), a gel, or plant material (for example, tobacco leaves and/or parts of tobacco leaves). In such vaporizer devices 100, a resistive heating element 150 can be part of, or otherwise incorporated into or in thermal contact with, the walls of an oven or other heating chamber into which the vaporizable material 102 is placed. Alternatively, a resistive heating element 150 or elements can be used to heat air passing through or past the vaporizable material 102, to cause convective heating of the vaporizable material 102. In still other examples, a resistive heating element or elements can be disposed in intimate contact with plant material such that direct conductive heating of the plant material occurs from within a mass of the plant material, as opposed to only by conduction inward from walls of an oven.

The one or more heating elements 150 can be activated in association with a user puffing (i.e., drawing, inhaling, etc.) on a mouthpiece 130 of the vaporizer device 100 to cause air to flow from an air inlet, along an airflow path that passes the atomizer 141 (i.e., wicking element and heating element 150). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element 150 can be activated via the controller 104, which can optionally be a part of a vaporizer body 110 as discussed herein, causing current to pass from the power source 112 through a circuit including one or more resistive heating elements, which is optionally part of a vaporizer cartridge 120 as discussed herein. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element 150 can be caused by automatic detection of a puff based on one or more signals generated by one or more sensors 113. The sensor(s) 113 and the signals generated by the sensor(s) 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate one or more heating elements 150 to reach an operating temperature for creation of an inhalable dose of vapor/aerosol. Other functions of the vaporizer device 100 can be controlled by interaction of a user with a user interface on a computing device in communication with the vaporizer device 100.

The temperature of a resistive heating element of the vaporizer device 100 can depend on a number of factors, including an amount of electrical power delivered to the resistive heating element and/or a duty cycle at which the electrical power is delivered, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (i.e., air moving across the heating element 150 or the atomizer 141 as a whole when a user inhales on the vaporizer device 100). As noted herein, to reliably activate the heating element 150 or heat the heating element 150 to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element 150 can be activated in association with a user's puff, for example by automatic detection of the puff, or by the sensor 113 detecting a change (such as a pressure change) in the airflow path.

The sensor 113 can be positioned on or coupled to (i.e., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer, the seal 127 can also separate parts of one or more electrical connections between the vaporizer body 110 and the vaporizer cartridge 120. Such arrangements of the seal 127 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

Figure 1B:
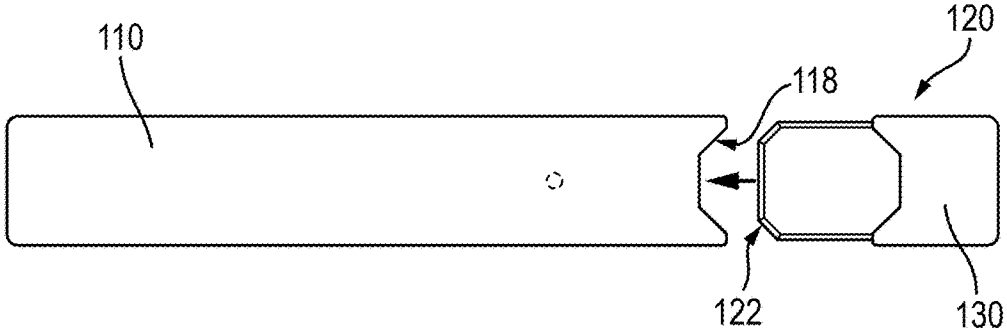
FIG. 1B is a schematic representation of the vaporizer device of FIG. 1A including a vaporizer body and a vaporizer cartridge.

In some implementations, the vaporizer body 110 includes the controller 104, the power source 112 (for example, a battery), one or more sensors 113, charging contacts (such as those for charging the power source 112), the seal 127, and a cartridge receptacle 118 configured to receive and/or releasably couple (e.g., via one or more of a variety of attachment structures) the vaporizer cartridge 120 to the vaporizer body 110, as shown in FIG. 1B. Other configurations in which a vaporizer cartridge 120 is coupled to a vaporizer body 110 without being inserted into a cartridge receptacle 118 are also within the scope of the current subject matter. It will be understood that the references herein to "receptacle contacts" can more generally refer to contacts on a vaporizer body 110 that are not contained within the cartridge receptacle 118 but are nonetheless configured to make electrical connections with the cartridge contacts 124 of the vaporizer cartridge 120 when the vaporizer cartridge 120 and the vaporizer body 110 are coupled. Some embodiments of the cartridge receptacle 118 can include a cartridge interface along at least one side of the vaporizer body 110 that includes one or more features for allowing the vaporizer cartridge 120 to releasably couple thereto. The cartridge interface and/or cartridge receptacle 118 can include one or more receptacle contacts 125 (e.g., four configured to connect to one or more corresponding cartridge contacts 124 (e.g., four cartridge contacts 124) and complete a circuit with the one or more heating elements 150 (e.g., two heating elements 150).

In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and a heating element 150. Alternatively or in addition, the vaporizer cartridge 120 can generate an inhalable dose of a vaporizable material 102 that is not a liquid, such as via heating of a solid material. For example, the vaporizer cartridge 120 can include a mass of a plant material that is processed and formed to have direct contact with parts of one or more resistive heating elements 150, and the vaporizer cartridge 120 can be configured to be coupled mechanically and/or electrically to the vaporizer body 110 that includes the controller 104, the power source 112, and one or more receptacle contacts 125 configured to connect to one or more corresponding cartridge contacts 124 and complete a circuit with the one or more resistive heating elements 150.

In an embodiment of the vaporizer device 100 in which the power source 112 is part of the vaporizer body 110, and a heating element 150 is disposed in the vaporizer cartridge 120 configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element 150 (for example, a heating element 150 within the atomizer 141). These features can include one or more contacts (referred to herein as cartridge contacts 124) on a bottom surface of the vaporizer cartridge 120 and at least two contacts (referred to herein as receptacle contacts 125) disposed near a base of the cartridge receptacle 118 and/or along the cartridge interface of the vaporizer body 110. The cartridge contacts 124 and the receptacle contacts 125 make electrical connections when the vaporizer cartridge 120 is inserted into and/or coupled with the cartridge receptacle 118 (e.g., a cartridge interface along one or more sides of the vaporizer body 110). The circuit completed by these electrical connections can allow delivery of electrical current to one or more heating elements 150 and can further be used for additional functions, such as measuring a resistance of the heating element 150 for use in determining and/or controlling a temperature of the heating element 150 based on a thermal coefficient of resistivity of the heating element 150.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110 and/or releasably coupling the vaporizer cartridge 120 to a cartridge interface of the vaporizer body 110), the detents or protrusions of the vaporizer body 110 can, for example, fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118. Other variations of the attachment structure are within the scope of this disclosure. For example, some implementations of the attachment structure can include the vaporizer cartridge 120 having the one or more detents, such as along one or more exterior surfaces of the vaporizer cartridge 120. The vaporizer body 110 can include the corresponding recesses that can fit and/or otherwise snap over such detents or protruding portions of the vaporizer cartridge 120, such as when the vaporizer cartridge 120 is inserted into the cartridge receptacle 118 on the vaporizer body 110.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein. In some implementations, the vaporizer cartridge 120 is not inserted into the vaporizer body 110 to achieve coupling between the vaporizer cartridge 120 and vaporizer body 100. For example, the cartridge receptacle 118 may include a surface having one or more features that assist with coupling the vaporizer cartridge 120 to the vaporizer body 110. Furthermore, such surface of the cartridge receptacle 118 may not be within a recess or other feature that requires the vaporizer cartridge to be inserted into for achieving coupling of the vaporizer cartridge 120 to the vaporizer body 110.

The cartridge contacts 124 and the receptacle contacts 125 can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

FIG. 1B illustrates an embodiment of the vaporizer body 110 and the cartridge receptacle 118 into which the vaporizer cartridge 120 can be releasably inserted. FIG. 1B shows a top view of the vaporizer device 100 illustrating the vaporizer cartridge 120 positioned for insertion into the vaporizer body 110. When a user puffs on the vaporizer device 100, air can pass between an outer surface of the vaporizer cartridge 120 and an inner surface of the cartridge receptacle 118 on the vaporizer body 110. Air can then be drawn into the cartridge, passed by and/or adjacent to one or more heating elements of the cartridge 120, and out through an outlet of the cartridge 120. For example, in some embodiments the air can then be drawn into the insertable end 122 of the cartridge, through the vaporization chamber that includes or contains the heating element and wick, and out through an outlet of the mouthpiece 130 for delivery of the inhalable aerosol to a user.

The reservoir 140 of the vaporizer cartridge 120 can be formed in whole or in part from translucent material such that a level of the vaporizable material 102 is visible within the vaporizer cartridge 120. The mouthpiece 130 can be a separable component of the vaporizer cartridge 120 or can be integrally formed with other component(s) of the vaporizer cartridge 120 (for example, formed as a unitary structure with the reservoir 140 and/or the like). The vaporizer cartridge 120 can also include a cannula running through the reservoir 140 from the atomizer 141 to the mouthpiece 130 of the vaporizer cartridge 120. Air can flow into the vaporizer cartridge 120, through the cannula, and out the mouthpiece 130 to the user. In some embodiments, the vaporizer cartridge 120 can include a gasket configured to provide a seal between the atomizer 141 and the reservoir 140 and the cannula. Additionally and/or alternatively, the cannula can be in fluid communication with the atomizer 141 and a condensation chamber, to deliver the vaporizable material 102 from the atomizer 141 to the condensation chamber. The condensation chamber can be in fluid communication with the atomizer 141, and configured to generate an aerosol from the vaporizable material 102.

Further to the discussion above regarding the electrical connections between the vaporizer cartridge 120 and the vaporizer body 110 being reversible such that at least two rotational orientations of the vaporizer cartridge 120 in the cartridge receptacle 118 are possible, in some embodiments of the vaporizer device 100, the shape of the vaporizer cartridge 120, or at least a shape of the insertable end 122 of the vaporizer cartridge 120 that is configured for insertion into the cartridge receptacle 118, can have rotational symmetry of at least order two. In other words, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

Various embodiments of a vaporizer cartridge 120 are described herein that are configured for containing and vaporizing one or more vaporizable materials 102, such as at least two vaporizable materials 102. The vaporizable material 102 can include a liquid vaporizable material and/or a solid vaporizable material. The vaporizer cartridges 120 disclosed herein may be limited or single-use such that at least one compartment 142 configured for containing vaporizable material 102 is not replaceable or refillable, such as after the vaporizable material 102 has been used up. For example, a limited-use vaporizer cartridge 120 can include more than one compartment 142, such as a first compartment that is replaceable or refillable with a vaporizable material 102 and a second compartment that is not refillable or replaceable. As such, the use of such cartridges 120 can depend on the amount of vaporizable material 102 contained in the second compartment. For example, after the vaporizable material 102 in the second compartment is depleted, the cartridge 120 can be disposed of. Such limited-use or single-use vaporizer cartridges 120 may thus require inexpensive material and manufacturing in order to be economically feasible. For example, some vaporizer cartridges 120 can include more than one compartment 142 that can each contain a vaporizable material 102 for heating and forming an inhalable aerosol. Additionally, some vaporizer cartridges 120 can include more than one compartment 142 that are each replaceable and/or refillable (e.g., with a vaporizable material).

For example, some embodiments of the vaporizer cartridge 102 disclosed herein can include a first compartment configured for heating and/or vaporizing a liquid vaporizable material and a second compartment configured for heating and/or vaporizing a solid vaporizable material 102. In addition, the first compartment can be replaceable (e.g., with a new first compartment containing liquid vaporizable material) independently from or in combination with the second compartment, which can also be replaceable (e.g., with a new second compartment containing non-liquid vaporizable material. For example, when vaporizable material 102 is depleted in the second compartment and not the in the first compartment, the second compartment can be replaced while leaving the first compartment coupled to vaporizer cartridge 102, such as for continued use. Similarly, the first compartment can be replaced while keeping the second compartment coupled to the vaporizer cartridge 102. This can allow selective replacement of vaporizable material 102 in the vaporizer cartridge 102. Such selective replacement can reduce waste, such as having to dispose of a vaporizer cartridge due to only one compartment being depleted of vaporizable material 102.

As used herein, the term non-liquid vaporizable material generally refers to vaporizable material that includes solid materials. For example, some vaporizer devices heat materials having origins as plant leaves or other plant components in order to extract plant specific flavor aromatics and other products as aerosol. These plant materials may be chopped and blended into a homogenized construct with a variety of plant products that may include tobacco, in which case nicotine and/or nicotine compounds may be produced and delivered in aerosol form to the user of such a vaporizer device. The homogenized construct may also include vaporizable liquids such as propylene glycol and glycerol in order to enhance the vapor density and aerosol produced when heated. In order to avoid production of unwanted harmful or potentially harmful constituents (HPHCs) vaporizer devices 100 of this type benefit from heating elements 150 having temperature control means. Such vaporizer devices 100 that heat plant leaves or homogenized construct such that temperatures are kept below combustion levels are generally referred to as heat not burn (HNB) devices.

As used herein, the term liquid vaporizable material generally refers to vaporizable material 102 without solid materials. The liquid vaporizable material can include, for example, a liquid, a solution, a wax, or any other form as may be compatible with use of a specific vaporizer device. In some implementations, a liquid vaporizable material can include any form suitable to utilize a wick or wicking element to draw the vaporizable material into a vaporization chamber.

In vaporizer devices where fluids are vaporized by causing a heating element to come into contact with the fluids to be vaporized, contamination of the heating element can occur leading to potential for compromising performance. A solution to this problem can be to incorporate the heating element into a disposable part of the vaporizer device such that the heating element is replaced with each new disposable part and thereby limiting, but not eliminating, heating element contamination. Furthermore, heating efficiency and effectiveness of some heating elements can reduce over time such that replacing the heating element in a vaporizer device can be desirable.

Various vaporizer cartridges 120 are described herein that include one or more heating elements 150 for heating more than one vaporizable material 102, such as for forming a combined aerosol for inhalation by a user. Additionally, such vaporizer cartridges 120 can include one or more compartments 142 that are each configured to contain at least a vaporizable material 102, and at least one of the compartments 142 can be either refillable or replaceable. Such vaporizer cartridges 120 can thus have prolonged use compared to vaporizer cartridges 120 that cannot refill or replace vaporizable material 102. Additionally, such vaporizer cartridges 120 can allow the vaporizer body 110 of the vaporizer device 100 to have prolonged use associated with efficient and effective heating, such as due to the periodic replacement of the heating elements 150 (as the vaporizer cartridges 120 are replaced).

Furthermore, it can be desirable for vaporizer cartridges 120 to have compact and user-friendly configurations. As such, the vaporizer cartridges 120 disclosed herein can contain and vaporize at least one vaporizable material 102 (e.g., at least two different vaporizable materials 102) and have various configurations that are compact and user-friendly while also being relatively inexpensive to manufacture compared to some currently available cartridges.

Embodiments of the heating elements 150 can include at least one thermally conductive material, such as carbon, carbon foam, metal, metal foil, aluminum foam, or a biodegradable polymer. The thermally conductive material can allow energy provided by a vaporizer device to be transmitted to the thermally conductive feature (e.g., via the cartridge and vaporizer device contacts) to thereby cause an increase in temperature along at least a part of the thermally conductive feature, such as for vaporizing the vaporizable material 102. The vaporizer body 110 can include a controller that can control the amount of energy provided to the thermally conductive material, thereby assisting the heating element 150 with reaching a temperature that is within the desired temperature range.

The circuit completed by the electrical connections between the vaporizer body 110 and the vaporizer cartridge 120 can allow delivery of electrical current to the one or more heating elements 150 and may further be used for additional functions, such as for measuring a resistance of the resistive heating element for use in determining and/or controlling a temperature of the resistive heating element based on a thermal coefficient of resistivity of the resistive heating element, as well as for identifying a cartridge 120 based on one or more electrical characteristics of a resistive heating element or the other circuitry of the vaporizer cartridge 120, etc. The vaporizer device 100 (and other features described herein in accordance with one or more implementations) may include circuitry having a heating element 150 comprising a nonlinear positive temperature coefficient of resistance material, or features thereof, for example heating elements 150 consistent with the as example implementations described in further detail below.

In some implementations of the current subject matter, the cartridge contacts 124 and the receptacle contacts 125 can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contacts 124 are electrically connected to the receptacle contacts 125. Furthermore, the one or more circuits necessary for operation of the vaporizer device 100 can be completed by insertion of the vaporizer cartridge 120 in the cartridge receptacle 118 in a second rotational orientation such that the cartridge contacts 12 are electrically connected to the receptacle contacts 125.

Further to and in addition to the above disclosure, various embodiments of a vaporizer device 100 are described herein that may heat more than one vaporizable material 102 using more than one heating element 150.

Vaporizers 100 that include the heating and airflow systems described herein (e.g., heating and airflow systems shown in FIGS. 2A-9) may provide one or more of a variety of benefits over currently available vaporizer devices. For example, the heating and airflow systems described herein may provide a combined aerosol (e.g., inhalable elements from liquid and solid vaporizable material). Other benefits may include the ability to provide the combined aerosol on-demand thereby not requiring a user to have to wait for a heating element to reach a required temperature. Such heat-up time may typically be required for drawing inhalable extracts from solid vaporizable material. In the heating and airflow systems described herein, the inhalable extracts are drawn from both solid and liquid vaporizable materials where the liquid vaporizable materials may be vaporized more efficiently and effectively on-demand. Furthermore, the heating element 150 configured to heat and/or vaporize the solid vaporizable material may heat to a temperature (e.g., less than 150 degrees Celcius) that eliminates the potential for charring (e.g., reduce or eliminate amount of harmful and potentially harmful constituents produced) combined with the ability to start and stop a session at will, including multiple times with the same cartridge 120 and/or heating and airflow systems. As such, a user may be able to enjoy multiple sessions with a single cartridge 120 and not have to consume or use the entire solid vaporizable material contained in the cartridge and/or heating and airflow systems in a single session. For example, since the solid vaporizable material (e.g., tobacco) may be refreshed by vapor produced in the atomizer chamber, the user experience may be consistent throughout the session and subsequent sessions. Other benefits of the vaporizers 100 and heating and airflow systems described herein are within the scope of this disclosure.

Figure 2A:
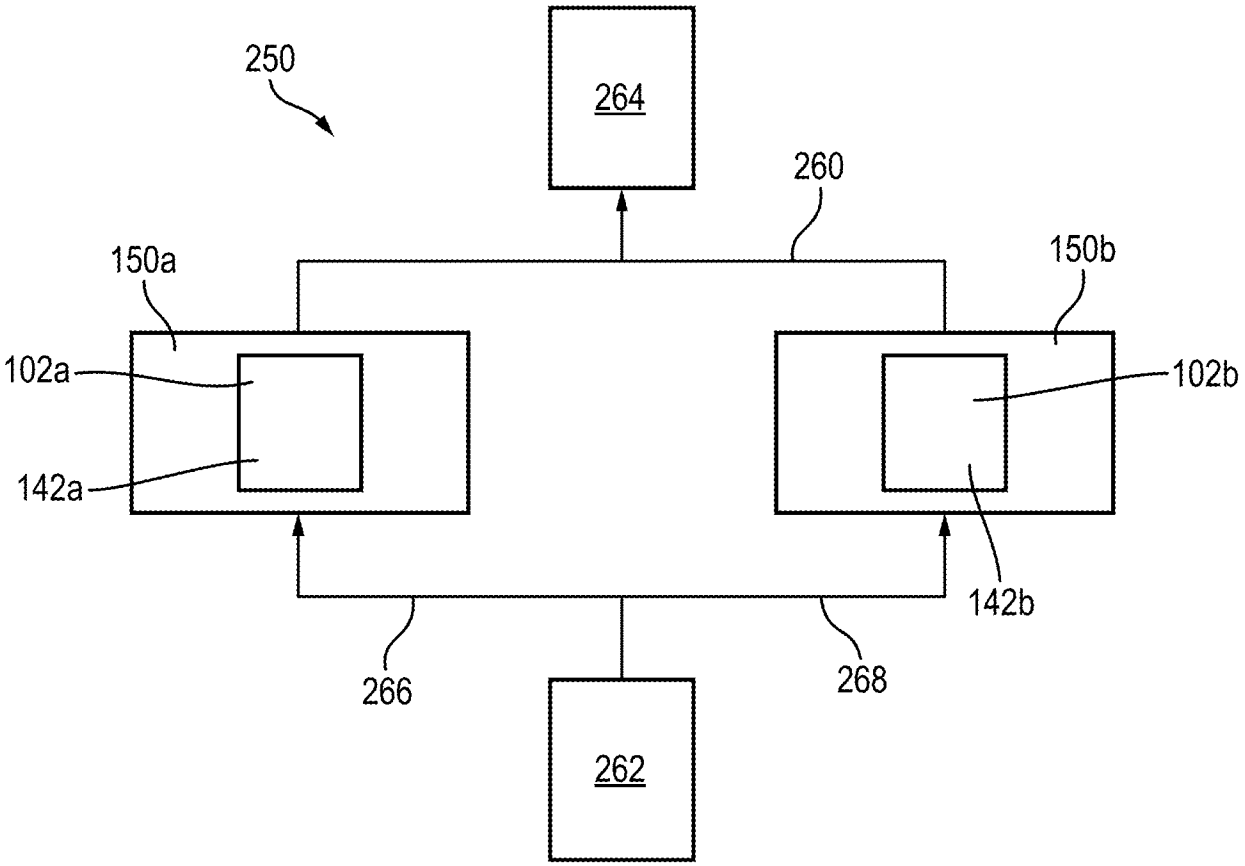
FIG. 2A illustrates a block diagram of an embodiment of a heating and airflow system of an embodiment of the vaporizer device.
Figure 2B:
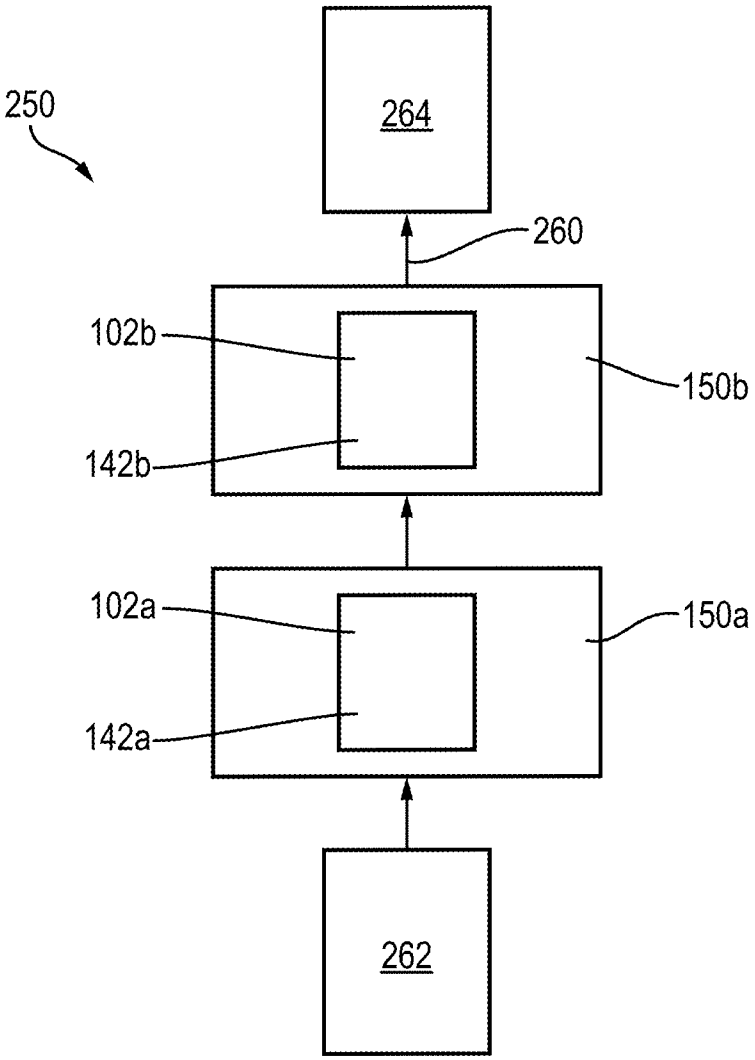
FIG. 2B illustrates a block diagram of another embodiment of a heating and airflow system of an embodiment of the vaporizer device.

FIGS. 2A and 2B illustrate first and second embodiments of a heating and airflow system 250 of a vaporizer device consistent with implementations of the current subject matter. For example, all or part of the heating and airflow systems 250 shown in FIGS. 2A and 2B may be contained in the vaporizer body 110 and/or in the vaporizer cartridge 120 configured to releasably couple to the vaporizer body 110. As shown in FIGS. 2A and 2B, the heating and airflow systems 250 include more than one heating element 150, such as a first heating element 150*a* that is configured to heat a first compartment or chamber 142*a* configured to hold a first vaporizable material 102*a*. Additionally, the heating and airflow systems 250 include a second heating element 150*b* that is configured to heat a second compartment or chamber 142*b* configured to hold a second vaporizable material 102*b*. As such, the heating and airflow systems 250 of FIGS. 2A and 2B may produce a combined aerosol that includes inhalable extracts from both the first and second vaporizable materials. The first heating element 150*a* and the second heating element 150*b* may include the same or different configurations and type of heating element 150, and may be independently controlled. For example, the first heating element 150*a* and the second heating element 150*b* may be controlled to reach different temperatures and/or heat for different amounts of time.

For example, the first compartment 142*a* may be configured for containing a liquid vaporizable material and the first heating element 150*a* may be configured to heat or vaporize the liquid vaporizable material. Additionally, the second compartment 142*b* may be configured to contain a solid vaporizable material and the second heating element 150*b* may be configured to heat and/or vaporize the solid vaporizable material. As will be described in greater detail below, inhalable extracts from both the liquid and solid vaporizable material may be combined for inhalation by a user.

For example, FIG. 2A shows an airflow pathway 260 that includes an inlet 262, an outlet 264, and a first pathway 266 and a second pathway 268 that extend between the inlet 262 and outlet 264. The first pathway 266 may pass through or adjacent the first heating element 150*a* and/or first compartment 142*a* to allow inhalable extracts (e.g., within an aerosol) created from heating and/or vaporizing the liquid vaporizable material to mix with the airflow passing through the vaporizer device 100. Additionally, the second pathway 268 may pass through or adjacent the second heating element 150*b* and/or second compartment 142*b* to allow inhalable extracts created from heating and/or vaporizing the solid vaporizable material to mix with the airflow passing through the vaporizer device 100.

As shown in FIG. 2A, when a user inhales on the vaporizer device 100 (such as on the mouthpiece 130), airflow may be drawn into the inlet 262 and along the airflow pathway 260. For example, a first part of the airflow may travel along the first pathway 266, including through and/or adjacent the first compartment 142*a* and/or first heating element 150*a*, thereby collecting the inhalable extracts of the liquid vaporizable material. Additionally, a second part of the airflow may travel along the second pathway 268, including through and/or adjacent the second compartment 142*b* and/or second heating element 150*b*, thereby collecting inhalable extracts of the solid vaporizable material. The first part and second part of the airflow pathway may converge prior to passing through the outlet 264 (e.g., a port along the mouthpiece 130). For example, the first pathway 266 and the second pathway 268 may converge at a mixing chamber that allows the inhalable extracts from the liquid and solid vaporizable material to be combined prior to traveling out the outlet 264 for inhalation by a user.

Various airflow pathways 260 may be implemented in the heating and airflow system 250 and are within the scope of this disclosure. For example, as shown in FIG. 2B, the airflow pathway 260 may include a single airflow pathway 260 that travels through and/or adjacent to the first heating element 150*a* and the first compartment 142*a*, as well as the second heating element 150*b* and the second compartment 142*b*. As such, the airflow passing through and/or adjacent to the second heating element 150*b* and second compartment 142*b* may include inhalable extracts from the heated and/or vaporized first vaporizable material 102*a*. Inhalable extracts from the heated and/or vaporized second vaporizable material 102*b* may be added to the airflow such that the airflow exiting the outlet 264 includes the combined aerosol.

Figure 3:
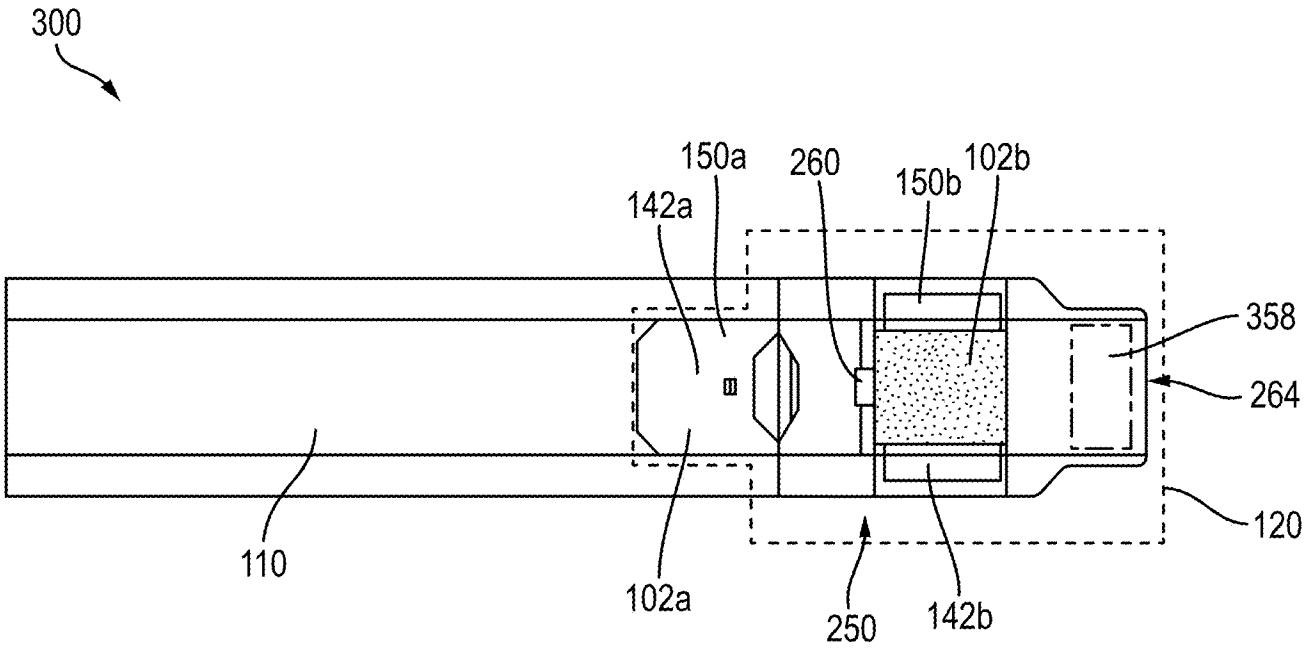
FIG. 3 illustrates a top view of an embodiment of a vaporizer device including the heating and airflow system of FIG. 2B.

FIG. 3 illustrates an example embodiment of a vaporizer device 300 including a removable vaporizer cartridge 120 coupled to a vaporizer body 110 and a heating and airflow system 250 consistent with this disclosure, such as the heating and airflow system 250 shown in FIG. 2B. As shown in FIG. 3, the vaporizer cartridge 120 includes a first compartment 142*a* including liquid vaporizable material (e.g., humectants) that may be vaporized by a first heating element 150*a*. Additionally, the vaporizer cartridge 120 includes a second compartment 142*b* including solid vaporizable material (e.g., tobacco blends) that may be heated and/or vaporized by a second heating element 150*b*. The airflow pathway 260 of the vaporizer device 300 shown in FIG. 3 may travel linearly through and/or adjacent the first heating element 150*a* and the second heating element 150*b* to collect and combine inhalable extracts from the liquid vaporizable material and solid vaporizable material for inhalation by a user. In some embodiments, other inhalable extracts and/or other aerosol flavorants may be optionally provided in a flavor filter 358. The flavor filter 358 may be positioned between the second compartment 142*b* and the outlet 264, as shown in FIG. 3.

Figure 4:
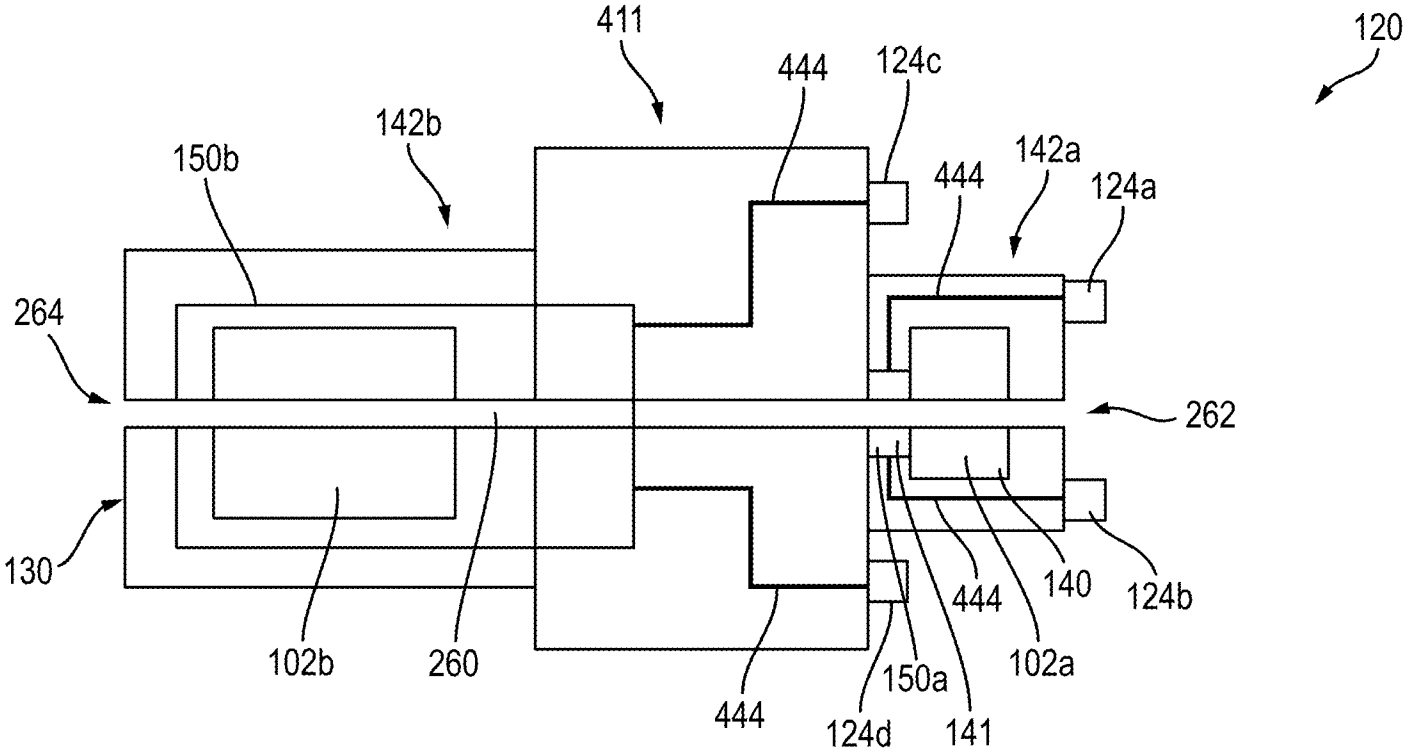
FIG. 4 is a block diagram of an embodiment of the vaporizer cartridge consistent with implementations of the current subject matter.

FIG. 4 is a block diagram of an embodiment of the vaporizer cartridge 120 consistent with implementations of the current subject matter. As shown in FIG. 4, the vaporizer cartridge 120 can include a cartridge body 411, an embodiment of the first compartment 142*a*, and an embodiment of the second compartment 142*b*. The first compartment 142*a* can include an embodiment of the reservoir 140 configured to contain a first vaporizable material 102*a* and the second compartment 142*b* can be configured to contain a second vaporizable material 102*b*. For example, the first vaporizable material 102*a* can be a liquid vaporizable material and the second vaporizable material 102*b* can be a solid vaporizable material. In other vaporizer cartridge 120 embodiments, the vaporizer cartridge 120 can include two or more compartments that are each configured to contain the same or different vaporizable material. For example, some vaporizer cartridge 120 embodiments can include two compartments that are both configured to contain a liquid vaporizable material or both configured to contain a solid vaporizable material without departing from the scope of this disclosure.

As shown in FIG. 4, the first compartment 142*a* can include an atomizer 141 including a first heating element 150*a* and a wick that is in communication with the reservoir 140 for drawing the first vaporizable material 102*a* to the first heating element 150*a* for heating and forming a first aerosol. The second compartment 142*b* can include a second heating element 150*b* that is configured to heat and vaporize the second vaporizable material 102*b*. In some embodiments, the second compartment 142*b* can include a chamber, and the second vaporizable material 102*b* and second heating element 150*b* can be at least partly positioned within the chamber for heating and vaporizing the second vaporizable material 102*b* to form a second aerosol. The vaporizer cartridge 120 can include an airflow pathway 260 that extends between an inlet 262 and an outlet 264. The airflow pathway 260 can travel along and/or adjacent to the atomizer 141 and second heating element 150*b* to allow the first and second aerosols to be entrained and combined in the airflow pathway to form the combined aerosol for inhalation. As shown in FIG. 4 the atomizer 141 can be upstream from the second heating element 150*b* such that the first aerosol can be passed through the second vaporizable material 102*b* to form the combined aerosol before passing through the outlet 264, such as for inhalation by a user. In some embodiments, the outlet 264 can be a part of a mouthpiece 130 from which a user can inhale the combined aerosol.

The first compartment 142*a* and/or the second compartment 142*b* can be releasably coupled to the cartridge body 411 of the vaporizer cartridge 120, such as to allow the first compartment 142*a* and/or second compartment 142*b* to be replaced with a new first compartment 142*a* and/or second compartment 142*b*, respectively. Additionally or alternatively, the first vaporizable material 102*a* and/or the second vaporizable material 102*b* can be refilled and/or replaced. For example, the second compartment 142*b* can allow the second vaporizable material 102*b* (e.g., a solid vaporizable material insert) to be inserted into the second compartment 142*b* (e.g., into the heating chamber) for heating and vaporizing. After vaporization of the second vaporizable material 102*b*, for example, a new vaporizable material insert can be inserted into the second compartment 142*b* for use. As such, the second compartment 142*b* can be configured to allow the second vaporizable material 102*b* to be replenished or refilled. Additionally or alternatively, the first compartment 142*a* can be configured to allow the first vaporizable material 102*a* to be replenished or refilled, such as by allowing the reservoir 140 of the first compartment 142*a* to be refilled with first vaporizable material 102*a*.

The vaporizer cartridge 120 can be configured to be coupled mechanically and/or electrically to a vaporizer body, such as the vaporizer body 110 of FIGS. 1A and 1B that includes the controller 104, the power source 112, and one or more receptacle contacts, such as receptacle contacts 125. As shown in FIG. 4, the vaporizer cartridge 120 can include a first pair of cartridge contacts 124*a* and 124*b* configured to couple with a first pair of corresponding receptacle contacts 125 for completing a circuit with the first heating element 150*a* of the atomizer 141. Additionally, the vaporizer cartridge 120 can include a second pair of cartridge contacts 124*c* and 124*d* configured to couple with a second pair of corresponding receptacle contacts 125 for completing a circuit with the second heating element 150*b*. As shown in FIG. 4, the cartridge body 411 can include a part of the airflow pathway 260 and/or at least a part of a conductive pathway 444 between one or more cartridge contacts 124 and one or more heating elements 150. For example, the second pair of cartridge contacts 124*c* and 124*d* can be coupled to the cartridge body 411 and at least some of the conductive pathway 444 can extend along or though the cartridge body 411 to the second heating element 150*b*.

Various other vaporizer cartridge 120 embodiments are described in detail below.

FIGS. 5A-5F illustrate another embodiment of the vaporizer cartridge 120 including a cartridge body 511, a first compartment 142*a*, and a second compartment 142*b*. The features and functions of the vaporizer cartridge 120 associated with FIGS. 5A-5F can include any one or more features and functions of the vaporizer cartridges associated with FIGS. 1A and 4. For example, the first compartment 142*a* can include a reservoir 140 for containing a first vaporizable material 102*a* (e.g., liquid vaporizable material), as well as an atomizer 141 including a wick and a first heating element 150*a* for vaporizing the first vaporizable material 102*a* and forming a first aerosol. The second compartment 142*b* can include a second heating element 150*a* and a tray 555 having one or more positioning features (e.g., a recess) configured to position a second vaporizable material 102*b*, such as a solid vaporizable material insert, along the tray 555 for positioning the second vaporizable material 102*b* adjacent to and/or in contact with the second heating element 150*b* for heating the second vaporizable material and forming a second aerosol.

The vaporizer cartridge 120 includes an airflow pathway 260 that extends between an inlet 262 (as shown, for example, in FIG. 5E) along the first compartment 142*a* and an outlet 264 (as shown, for example, in FIG. 5A) of the second compartment 142*b*. The airflow pathway 260 can extend through the first compartment 142*a* and atomizer 141, through the cartridge body 511 (as shown, for example, in FIG. 5D), and through the second compartment 142*b*. As such, the first aerosol formed by the first vaporizable material 102*a* can be passed through the second compartment 142*a*, and combined with the second aerosol to form a combined aerosol for inhalation by a user.

Figure 5A:
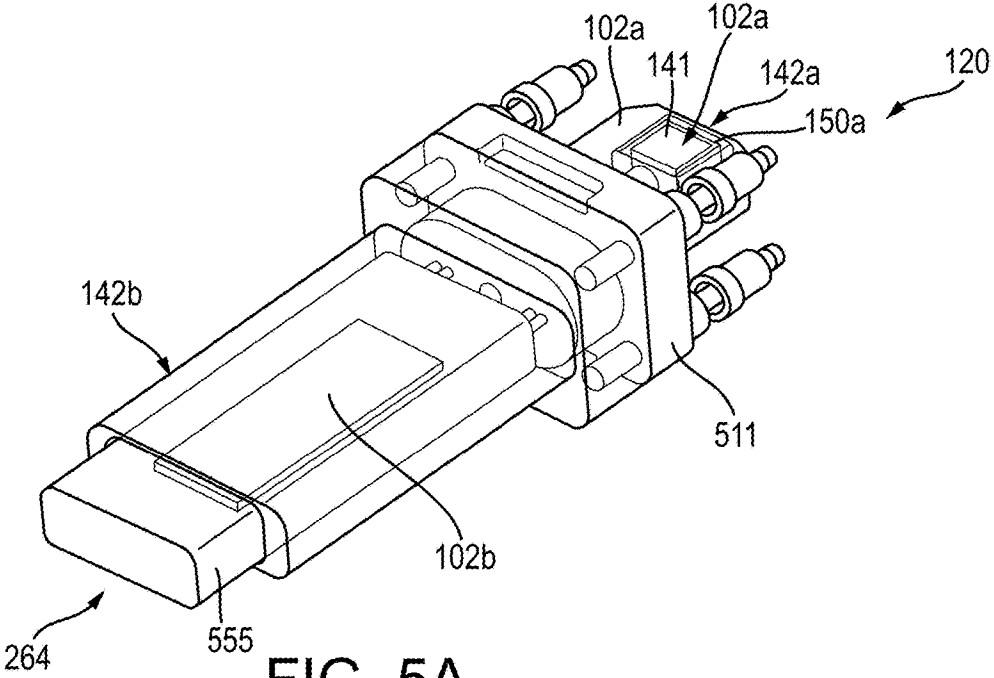
FIG. 5A illustrates a top perspective view of another embodiment of the vaporizer cartridge configured to separately contain and heat more than one vaporizable material.
Figure 5B:
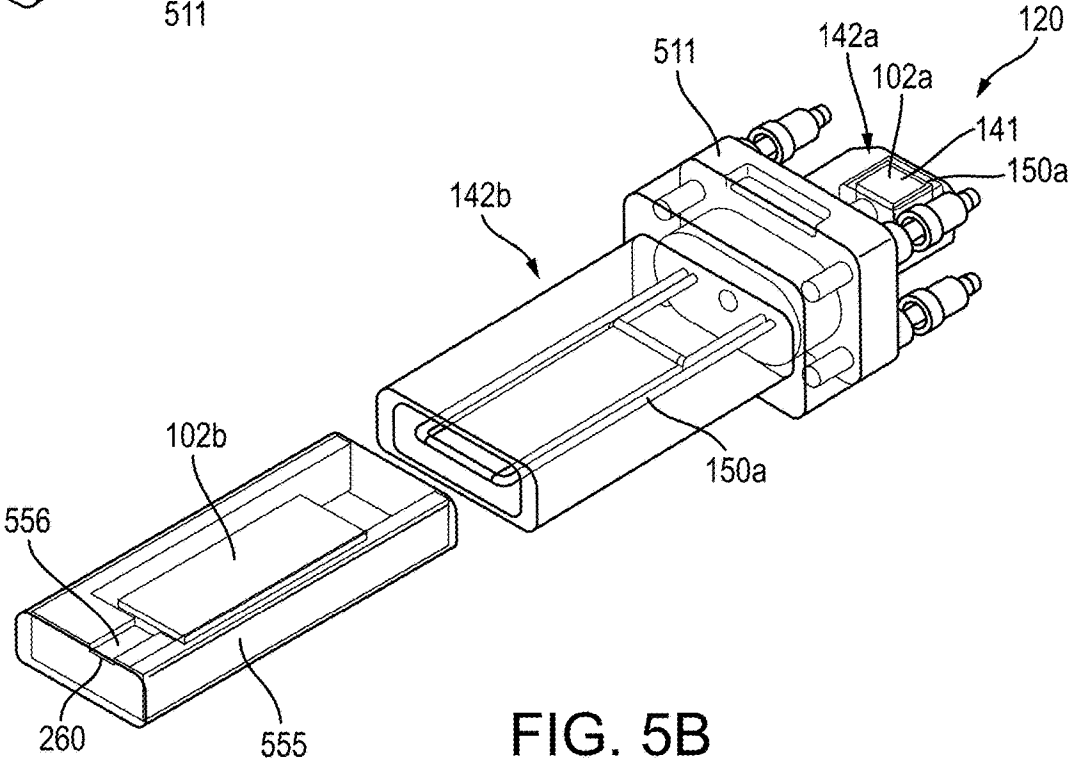
FIG. 5B illustrates a top perspective view of the vaporizer cartridge of FIG. 5A showing the vaporizer material insert removed from a compartment of the vaporizer cartridge.
Figure 5C:
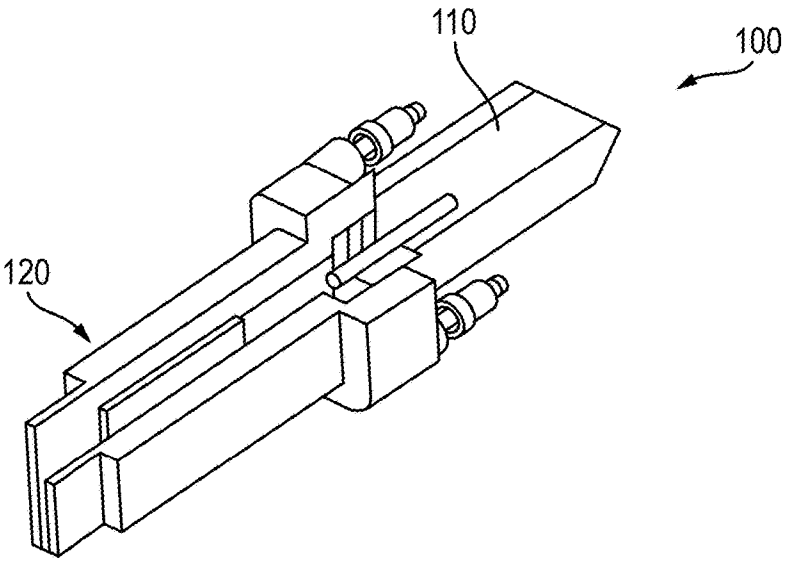
FIG. 5C illustrates a side partial section view of the vaporizer cartridge of FIG. 5A coupled to an embodiment of the vaporizer body.

As shown in FIG. 5B, at least one of the tray 555 and the vaporizable material insert 102*b* can include a part of the airflow pathway 260. For example, the airflow pathway 260 can include a channel 556 that extends along the tray 555. In some embodiments, the channel 556 can be intercepted by the second vaporizable material 102*b* (e.g., a vaporizable material insert including vaporizable material formed and compressed into a shape) coupled to the tray 555 such that airflow, including the first aerosol, can be forced to pass through the second vaporizable material 102*b* positioned in the tray 555. As shown in FIG. 5F, the tray 555 can include an opening 557 that allows the second heating element 150*b* to be releasably coupled to the tray 555. When coupled to the tray 555, the second heating element 150*b* can be placed adjacent to and/or in contact with the second vaporizable material 102*b* (as shown, for example, in FIG. 5E) for heating and vaporizing the second vaporizable material 102*b*.

Figure 5D:
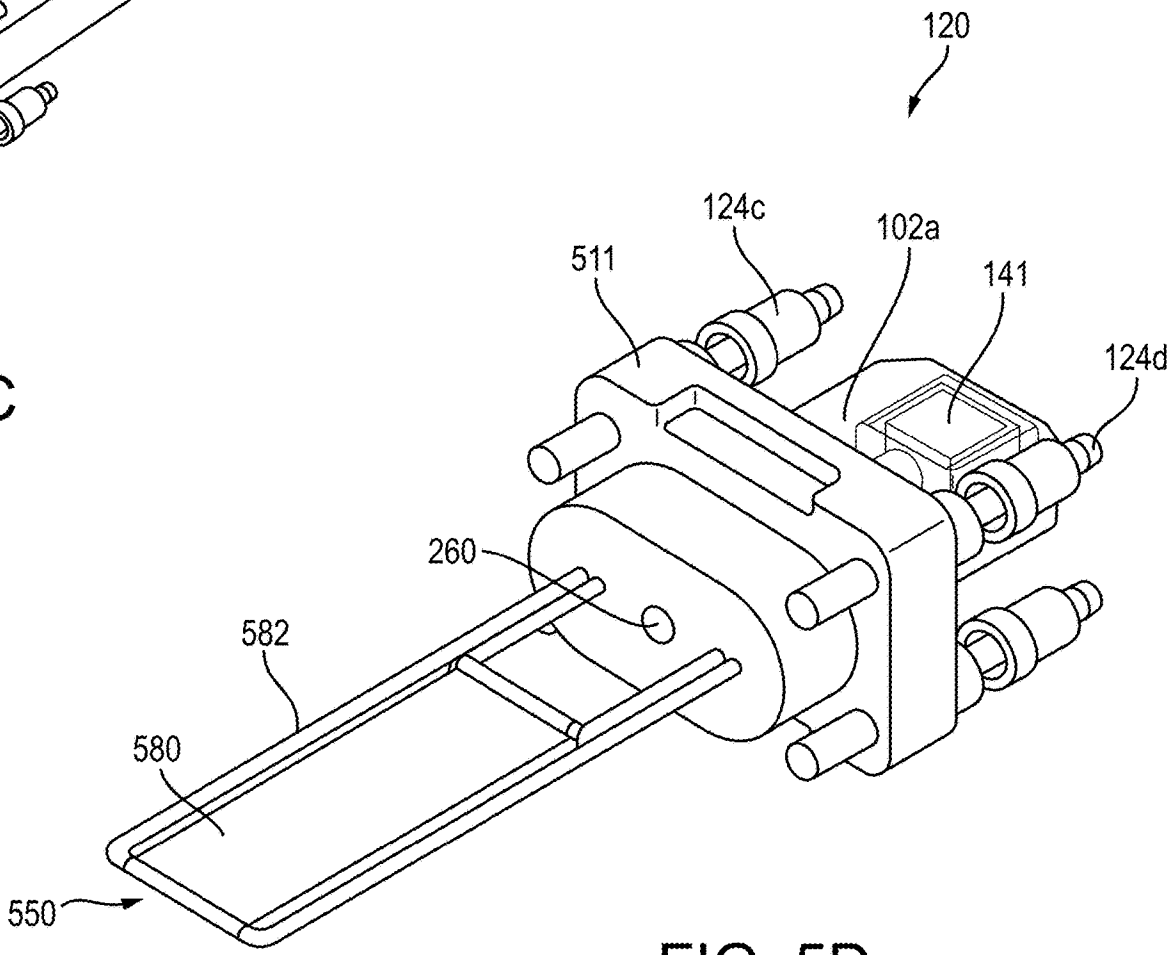
FIG. 5D illustrates a top perspective view of the vaporizer cartridge of FIG. 5A showing a heating element coupled to a body of the vaporizer cartridge.
Figure 5E:
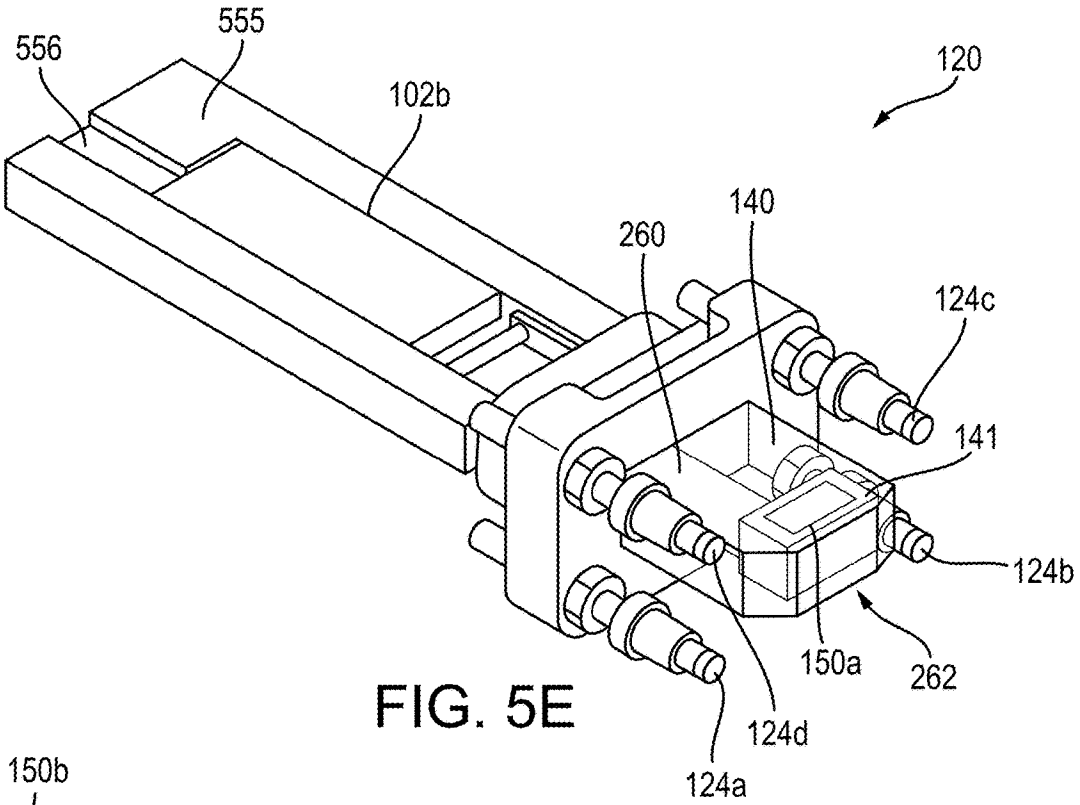
FIG. 5E illustrates a perspective view of the vaporizer cartridge of FIG. 5A showing a compartment that includes a reservoir configured to contain a liquid vaporizable material and an atomizer for vaporizing the liquid vaporizable material.
Figure 5F:
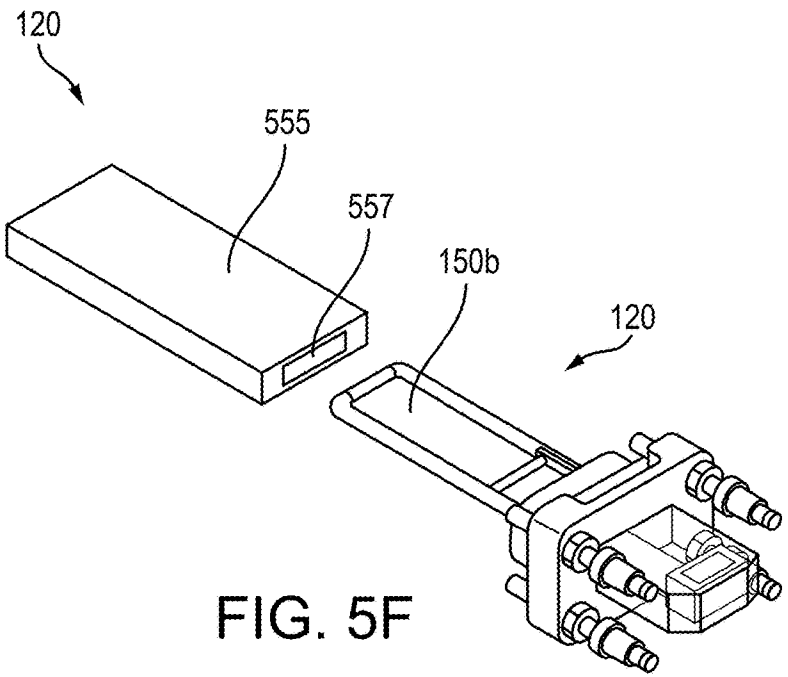
FIG. 5F illustrates a perspective view of the vaporizer cartridge of FIG. 5A showing a tray configured to position solid vaporizable material adjacent and/or in contact with one of the heating elements of the vaporizer cartridge.

As shown in FIG. 5D, the second heating element 150*b* can be a resistive heater that can heat and vaporize the second vaporizable material 102*b* via conductive heating. For example, the second heating element 150*b* can include a thermally conductive sheet 580 extending between a pair of electrically conductive support structures 582. The electrically conductive support structures 582 can extend into and/or couple to the cartridge body 511 (as shown, for example, in FIG. 5D) and can be in electrical communication with, for example, a second pair of cartridge contacts 124*c* and 124*d*. Additionally, the atomizer 141 can be in electrical communication with a first pair of cartridge contacts 124*a* and 124*b*. The first pair of cartridge contacts 124*a* and 124*b* and the second pair of cartridge contacts 124*c* and 124*d* can contact and/or couple to corresponding electrical contacts (such as the receptacle contacts 125 associated with FIG. 1A) along an embodiment of the vaporizer body 110 to which the vaporizer cartridge 120 is coupled to, such as shown in FIG. 5C.

Figure 5G:
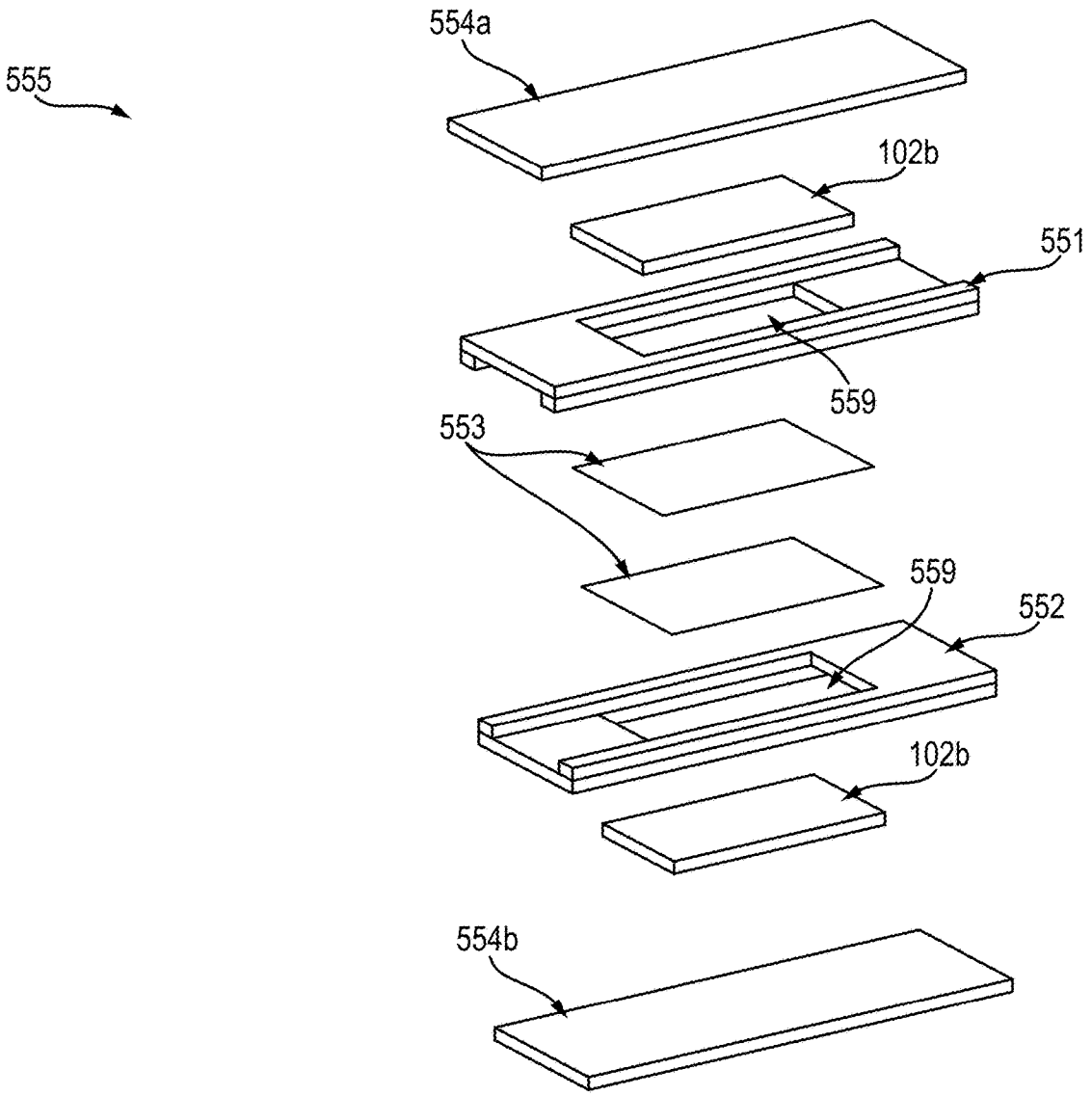
FIG. 5G illustrates an exploded view of an embodiment of a part of the vaporizer cartridge of FIG. 5A showing the tray and the solid vaporizable material formed into a vaporizable material insert for inserting in the tray.

FIG. 5G illustrates an exploded view of an embodiment of the tray 555 and second vaporizable material 102*b*, which can be formed into a vaporizable material insert having a rectangular shape. As shown in FIG. 5G, the tray 555 can include a top positioning structure 551 and a bottom positioning structure 552 that can each include a central opening 559 that can approximately align with the second vaporizable material 102*b* for securely positioning the second vaporizable material 102*b* along the tray 555. During use and when the tray 555 is coupled to and/or positioned within the second compartment 142*b*, the second heating element 150*b* can be positioned between the top positioning structure 551 and the bottom positioning structure 552, as well as positioned adjacent the second vaporizable material 102*b*. A protective shield 553 (e.g., paper material) can be positioned between the second heating element 102*b* and the second vaporizable material 102*b*, such as to protect the second vaporizable material 102*b* from overheating and/or protect the second heating element 150*b* from contamination. One or more parts of the protective shield 553 can be thermally conductive and/or thermally insulating. For example, the tray 555 can be replaced and/or refilled with second vaporizable material 102*b*, thus the second heating element 150*b* can be a reusable part of the vaporizer cartridge 120. As such, preventing contamination of the second heating element 150*b* can be desired, such as to ensure the second heating element 150*b* can maintain efficient and effective heating. As shown in FIG. 5G, the tray 555 can include a top shell 554*a* and a bottom shell 554*b* that can form an outer wall of the heating chamber of the second compartment 142*b*.

Figure 6A:
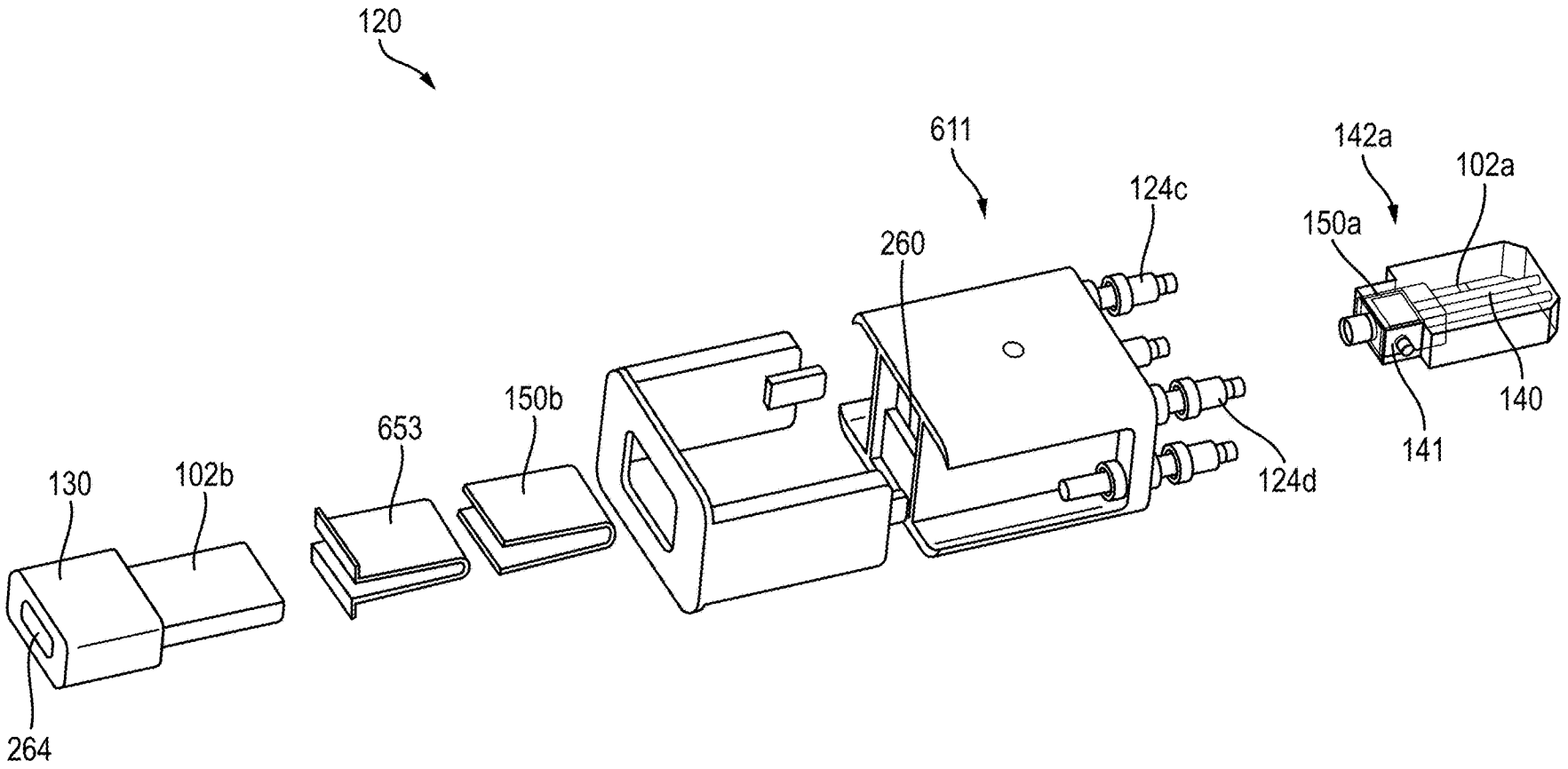
FIG. 6A illustrates an exploded view of another embodiment of a vaporizer cartridge.
Figure 6C:
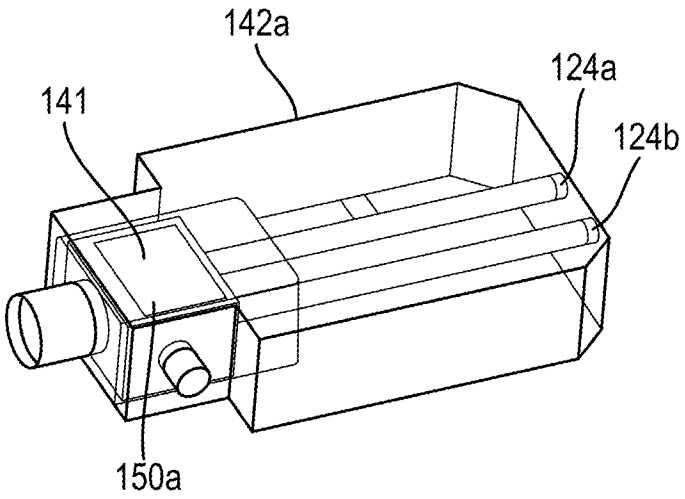
FIG. 6C illustrates a removable and/or refillable compartment of the cartridge of FIG. 6A that is configured to contain a liquid vaporizable material.
Figure 6B:
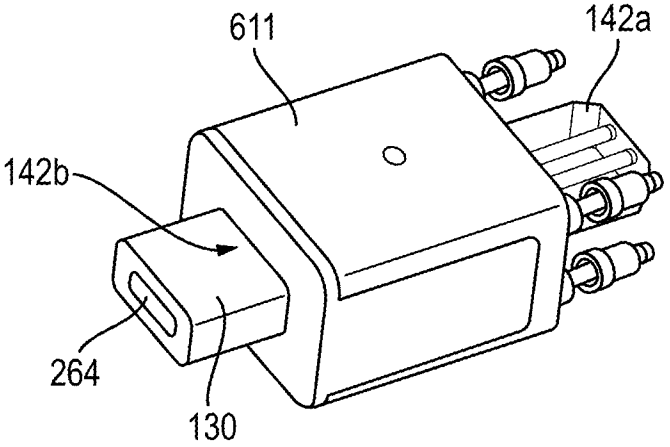
FIG. 6B illustrates a top perspective view of the vaporizer cartridge of FIG. 6A.

FIGS. 6A-6B illustrates an exploded view of another embodiment of a vaporizer cartridge 120. The features and functions of the vaporizer cartridge 120 associated with FIGS. 6A-6B can include any one or more features and functions of the vaporizer cartridge associated with FIGS. 1A and 4-5G. For example, the first compartment 142*a* can include a reservoir 140 for containing a first vaporizable material 102*a* (e.g., liquid vaporizable material), as well as an atomizer 141 including a wick and a first heating element 150*a* for vaporizing the first vaporizable material 102*a* and forming a first aerosol. The second compartment 142*b* can include a second heating element 150*b* and a thermally conductive barrier 653 that can be positioned between the second vaporizable material 102*b* and the second heating element 150*b*. The second heating element 150*b* can be in electrical communication with the second pair of cartridge contacts 124*c*, 124*d* and the atomizer 141 can be in electrical communication with a first pair of cartridge contacts 124*a*, 124*b*. As such, the first and second pairs of cartridge contacts can contact and/or couple to receptacle contacts 125 of a vaporizer body 110 for forming a circuit with a power source 112 in the vaporizer body 110 for activating the first and second heating elements 150*a* and 150*b* as described herein.

In some embodiments, the second vaporizable material 102*b* can be formed to have a wedge and/or a tapered distal end such that the tapered distal end is configured to be inserted in the cartridge body 611 (e.g., within a compartment 142 in the cartridge body 611). As shown in FIG. 6A, the second heating element 150*b* can have the same or similar shape as the second vaporizable material 102*b* such that the second heating element 150*b* conforms to and/or substantially contacts one or more sides of the second vaporizable material 102*b*. The thermally conductive barrier 653 can be positioned between the second vaporizable material 102*b* and second heating element 150*b* and provide a protective barrier between the second vaporizable material 102*b* and the second heating element 150*b*.

The vaporizer cartridge 120 can include an airflow pathway 260 that extends between an inlet along the first compartment 142*a* and an outlet 264, which can be part of an embodiment of the mouthpiece 130, as shown in FIGS. 6A and 6B. The second vaporizable material 102*b* can be positioned immediately upstream from the mouthpiece 130 thereby causing airflow (including aerosol) passing through the vaporizer cartridge 120 to pass through the second vaporizable material 102*b* prior to passing through the outlet 264. The airflow pathway 260 can extend through the first compartment 142*a* and atomizer 141, through the cartridge body 611 (as shown, for example, in FIG. 6A), and through the second compartment 142*b*. As such, the first aerosol formed by the first vaporizable material 102*a* can be passed through the second chamber 142*b*, and combined with the second aerosol to form a combined aerosol for inhalation by a user.

As shown in FIG. 6B, the second compartment 142*b* can be coupled to the cartridge body 611 during use such that the second compartment 142*b* is contained within the cartridge body 611, which can provide a compact configuration. As shown in FIG. 6B, the mouthpiece 130 can extend from the cartridge body 611 for user access. The second compartment 142*b* can be removed and replaced, such as by pulling on the mouthpiece 130 to remove the second compartment 142*b* from the cartridge body 611. In some embodiments, the mouthpiece 130 and second compartment 142*b* can be replaced with a new mouthpiece 130 and second compartment 142*b* containing second vaporizable material 102*b*. In some embodiments, the second heating element 150*b* can be a part of the cartridge body 611 such that replacement or replenishment of the second vaporizable material 102*b* does not include replacement of the second heating element 150*b*. In some embodiments, the first compartment 142*a* can be replaceable and/or refillable with first vaporizable material 102*a*.

Figure 7A:
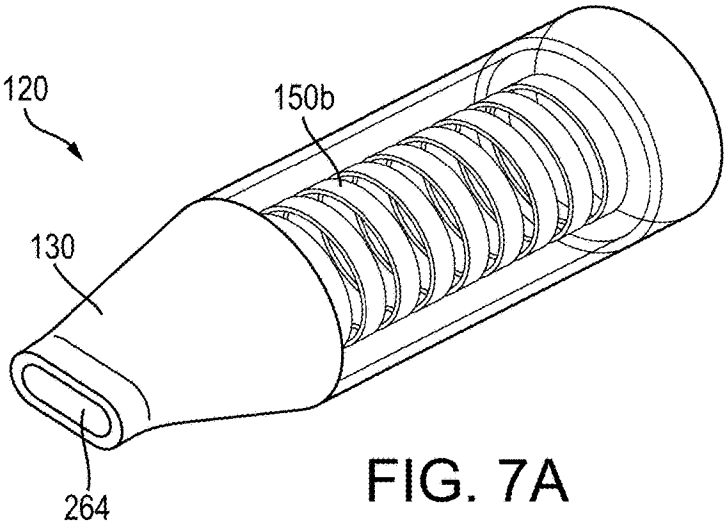
FIG. 7A illustrates a side perspective view of another embodiment of a vaporizer cartridge.
Figure 7B:
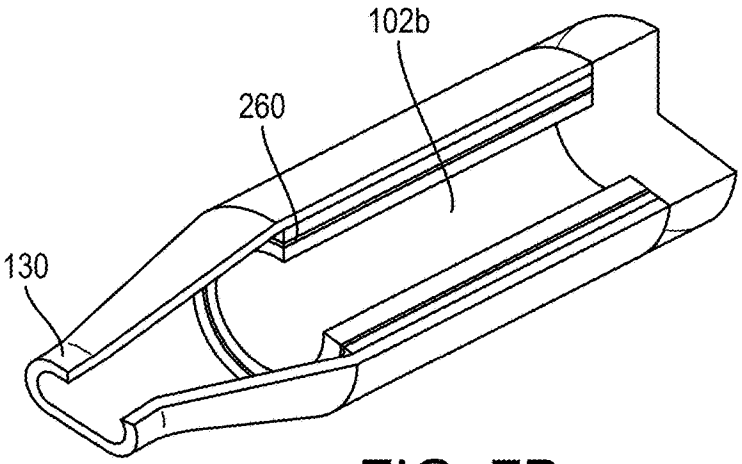
FIG. 7B illustrates a section view of the vaporizer cartridge of FIG. 7A.
Figure 7C:
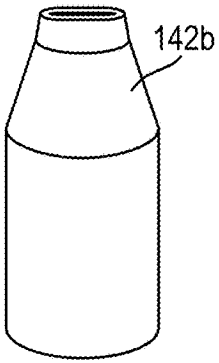
FIG. 7C illustrates a side view of a second compartment of the vaporizer cartridge of FIG. 7A.
Figure 7D:
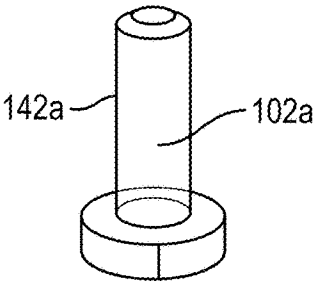
FIG. 7D illustrates a side view of a first compartment of the vaporizer cartridge of FIG. 7A.
Figure 7E:
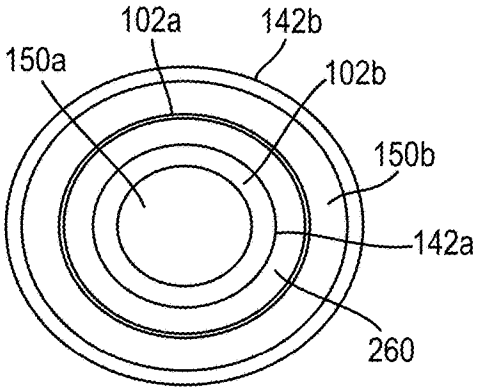
FIG. 7E illustrates a bottom view of the vaporizer cartridge of FIG. 7A.

The first and second compartments of the vaporizer cartridge 120 can include a variety of shapes and sizes. For example, as shown in FIGS. 7A-7E, the vaporizer cartridge 120 can include a cylindrical shape with the second compartment 142*b* including a hollow cylindrical shape. The second compartment 142*b* can contain a second vaporizable material 102*b* (e.g., solid vaporizable material) and include a second heating element 150*b*, such as a resistive heating coil that extends along a length of the second compartment, as shown in FIG. 7A. As shown in FIG. 7D, the first compartment 142*a* can also be cylindrical in shape and can be configured to contain a first vaporizable material 102*a* (e.g., humectant) and include a first heating element 150*a*. The first compartment 142*a* can be configured to at least partly be inserted into the hollow portion of the second compartment 142*b* thereby forming a compact configuration. Although described and shown as having cylindrical shapes, the vaporizer cartridge 120 of FIGS. 7A-7E can include a variety of shapes and sizes. As shown in FIG. 7B, airflow pathway 260 can travel along the second compartment thereby collecting first and second aerosol (e.g., approximately simultaneously) formed from the vaporized first and second vaporizable material to form a combined aerosol that can be passed through the outlet (e.g., part of a mouthpiece 130) for inhalation by a user.

Figure 8:
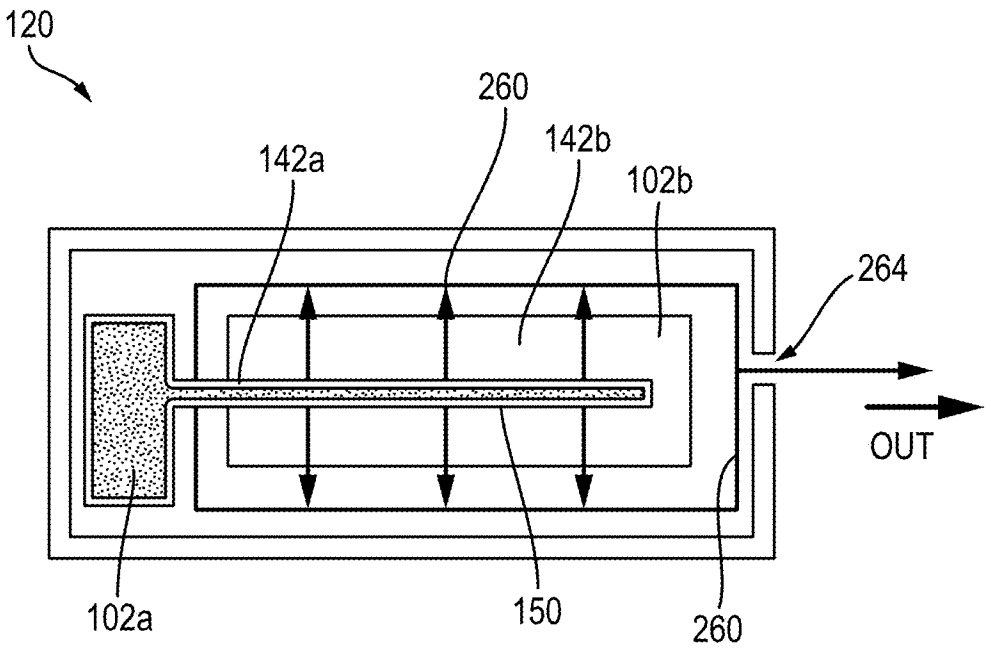
FIG. 8 illustrates a block diagram of another embodiment of a vaporizer cartridge.

FIG. 8 illustrates a block diagram of another embodiment of a vaporizer cartridge 120 showing multiple airflow pathways 260 that can extend from a first compartment 142*a* (e.g., containing a first vaporizable material 102*a*) and through a second compartment 142*b* (e.g., containing a second vaporizable material 102*b*). The vaporizer cartridge 120 shown in FIG. 8 can include at least one heating element 150, such as a heating element 150 positioned within the second compartment 142*b* and/or adjacent the first compartment 142*a* to heat and/or vaporize the first and second vaporizable materials 102*a* and 102*b* for forming an inhalable aerosol that can be passed through the outlet 264 for inhalation by a user.

Figure 9:
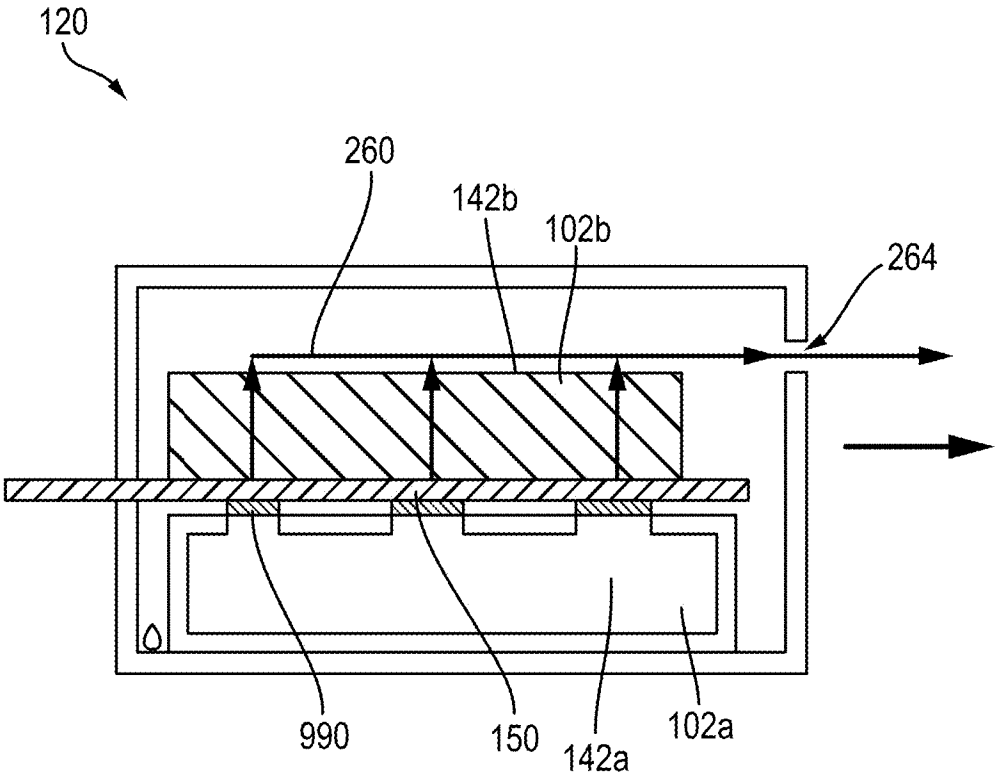
FIG. 9 illustrates a block diagram of another embodiment of a vaporizer cartridge including a single heating element for heating a liquid and solid vaporizable material.

FIG. 9 illustrates a block diagram of another embodiment of a vaporizer cartridge 120 showing multiple airflow pathways 260 that can extend from and/or adjacent to a first compartment 142*a* (e.g., containing a first vaporizable material 102*a*) and through a second compartment 142*b* (e.g., containing a second vaporizable material 120*b*). The vaporizer cartridge 120 shown in FIG. 9 includes a single heating element 150 extending between the first and second compartments 142*a* and 142*b* for heating and/or vaporizing the first and second vaporizable material 102*a* and 102*b* and forming an inhalable aerosol that can be passed through the outlet 264 for inhalation by a user. As shown in FIG. 9, some embodiments of the cartridge 120 can include one or more membranes 990 positioned along one or more openings in the first compartment 142*a* for absorbing and/or allowing the first vaporizable material 102*a* to be positioned adjacent the heating element 150 for heating and/or vaporizing the first vaporizable material 102*a*. Various other embodiments of the vaporizer cartridge are within the scope of this disclosure.

Terminology

When a feature or element is herein referred to as being "on" another feature or element, it can be directly on the other feature or element or intervening features and/or elements can also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements can be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature can have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device can be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers can be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value can have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes can be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system can include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on,"

herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A vaporizer device for generating a combined inhalable aerosol, the vaporizer device comprising:

a vaporizer cartridge comprising:

a body comprising:

a first side and a second side, the first side being opposite the second side;

a first receptacle extending through the first side and into the body; and a second receptacle extending through the second side and into the body;

a first compartment partially inserted into the first receptacle, wherein the first compartment is configured to contain a first vaporizable material and is further configured to selectively couple to and partially extend in a first direction from the first side of the body;

a first heating element adjacent the first compartment for heating the first vaporizable material and forming a first inhalable aerosol;

a second compartment partially inserted into the second receptacle, wherein the second compartment is configured to contain a second vaporizable material and is further configured to selectively couple to and partially extend in a second direction from the second side of the body, the first direction being opposite of the second direction;

a second heating element adjacent the second compartment for heating the second vaporizable material and forming a second inhalable aerosol; and an airflow pathway that extends adjacent the first heating element and the second heating element, the airflow pathway being configured to receive the first inhalable aerosol and the second inhalable aerosol and allow the first inhalable aerosol and the second inhalable aerosol to combine to form the combined inhalable aerosol for inhalation by a user from an end of the airflow pathway, wherein the body includes a part of the airflow pathway that extends from the first compartment to the second compartment, and wherein the airflow pathway extends through the second vaporizable material contained in the second compartment; and a vaporizer body comprising:

a power source configured to supply power to the first heating element and the second heating element when the vaporizer cartridge is coupled to the vaporizer body.

2. The vaporizer device of claim 1, wherein the vaporizer body further comprises:

a first pair of vaporizer body contacts in electrical communication with the power source; and a second pair of vaporizer body contacts in electrical communication with the power source; and wherein the cartridge further comprises:

a first pair of cartridge contacts in electrical and/or thermal communication with the first heating element; and a second pair of cartridge contacts in electrical and/or thermal communication with the second heating element, and wherein the first pair of cartridge contacts contact the first pair of vaporizer body contacts and the second pair of cartridge contacts contact the second pair of vaporizer body contacts when the vaporizer cartridge is coupled to the vaporizer body for allowing the power source to activate the first heating element and the second heating element.

3. A vaporizer cartridge for use with a vaporizer body for generating a combined inhalable aerosol, the vaporizer cartridge comprising:

a body comprising:

a first side and a second side, the first side being opposite the second side a first receptacle extending through the first side and into the body; and a second receptacle extending through the second side and into the body;

a first compartment partially inserted into the first receptacle, wherein the first compartment is configured to contain a first vaporizable material and is further configured to selectively couple to and partially extend in a first direction from the first side of the body;

a first heating element adjacent the first compartment for heating the first vaporizable material and forming a first inhalable aerosol;

a second compartment partially inserted into the second receptacle, wherein the second compartment is configured to contain a second vaporizable material and is further configured to selectively couple to and partially extend in a second direction from the second side of the body, the first direction being opposite of the second direction;

a second heating element adjacent the second compartment for heating the second vaporizable material and forming a second inhalable aerosol; and an airflow pathway that extends adjacent the first heating element and the second heating element, the airflow pathway being configured to receive the first inhalable aerosol and the second inhalable aerosol and allow the first inhalable aerosol and the second inhalable aerosol to combine to form the combined inhalable aerosol for inhalation by a user from an end of the airflow pathway, wherein the body includes a part of the airflow pathway that extends from the first compartment to the second compartment, and wherein the airflow pathway extends through the second vaporizable material contained in the second compartment.

4. The vaporizer cartridge of claim 3, wherein at least one of the first compartment and the second compartment is releasably coupled to the body of the vaporizer cartridge via a mechanical connection, an electrical connection, or both.

5. The vaporizer cartridge of claim 3, wherein the first vaporizable material comprises a liquid vaporizable material, and wherein the second vaporizable material comprises a solid vaporizable material, a liquid vaporizable material, or both.

6. The vaporizer cartridge of claim 3, wherein the first vaporizable material comprises a solid vaporizable material, and wherein the second vaporizable material comprises a solid vaporizable material, a liquid vaporizable material, or both.

7. The vaporizer cartridge of claim 6, wherein the second vaporizable material is positioned adjacent the end of the airflow pathway.

8. The vaporizer cartridge of claim 3, wherein at least one of the first compartment and the second compartment is refillable with a vaporizable material.

9. The vaporizer cartridge of claim 3, wherein the vaporizer cartridge further comprises:

a first pair of cartridge contacts in electrical and/or thermal communication with the first heating element; and a second pair of cartridge contacts in electrical and/or thermal communication with the second heating element, and wherein the first pair of cartridge contacts and the second pair of cartridge contacts assist with providing power to the vaporizer cartridge to activate the first heating element and the second heating element.

10. The vaporizer cartridge of claim 9, wherein the first compartment includes a reservoir for containing a liquid vaporizable material and an atomizer including the first heating element for heating the liquid vaporizable material to form a first inhalable aerosol.

11. The vaporizer cartridge of claim 10, wherein the first compartment includes a wick for drawing the first vaporizable material from the reservoir to the first heating element for heating and forming the first inhalable aerosol.

12. The vaporizer cartridge of claim 9, wherein the second heating element includes a thermally conductive sheet that extends from the body of the cartridge and into at least a part of the second compartment.

13. The vaporizer cartridge of claim 12, wherein the vaporizer cartridge further comprises a tray having a positioning feature configured to position the second vaporizable material along the tray, the tray configured for insertion into the second compartment for positioning the second vaporizable material adjacent to and/or in contact with the second heating element.

14. The vaporizer cartridge of claim 10, wherein the second vaporizable material is formed into a shape having a tapered distal end.

15. The vaporizer cartridge of claim 14, wherein the second heating element conforms to one or more sides of the second vaporizable material.

16. The vaporizer cartridge of claim 15, wherein the vaporizer cartridge further comprises a thermally conductive protective layer positioned between the second vaporizable material and the second heating element.

17. The vaporizer device of claim 1, wherein the first vaporizable material comprises a solid vaporizable material, and wherein the second vaporizable material comprises a solid vaporizable material, a liquid vaporizable material or both.

18. The vaporizer device of claim 1, wherein the first vaporizable material comprises a liquid vaporizable material, and wherein the second vaporizable material comprises a solid vaporizable material, a liquid vaporizable material or both.

19. The vaporizer device of claim 1, wherein at least one of the first compartment and the second compartment is refillable with a vaporizable material.

* * * * *